US007211221B1

(12) United States Patent
Areal Guerra

(10) Patent No.: US 7,211,221 B1
(45) Date of Patent: May 1, 2007

(54) DEVICE AND METHOD FOR MASS DEACIDIFICATION, ELIMINATION OF FREE ACIDITY AND DISINFESTATION OF CELLULOSIC MATERIALS

(75) Inventor: Rogelio Areal Guerra, Terrassa (ES)

(73) Assignee: Universidad Politecnica De Cataluna, Terrassa (ES)

( * ) Notice: Subject to any disclaimer, the term of this patent is extended or adjusted under 35 U.S.C. 154(b) by 0 days.

(21) Appl. No.: 09/980,030

(22) PCT Filed: May 26, 2000

(86) PCT No.: PCT/ES00/00188

§ 371 (c)(1),
(2), (4) Date: Mar. 5, 2002

(87) PCT Pub. No.: WO00/73584

PCT Pub. Date: Dec. 7, 2000

(30) Foreign Application Priority Data

May 27, 1999 (ES) ..... 9901152

(51) Int. Cl.
*B01J 19/00* (2006.01)

(52) U.S. Cl. ..... 422/40; 422/295; 427/430.1

(58) Field of Classification Search ..... 422/28, 422/33, 292, 40, 295; 427/399, 421.1, 430.1, 427/429; 516/88; 118/313, 315, 626, 629
See application file for complete search history.

(56) References Cited

U.S. PATENT DOCUMENTS 4,860,685 A * 8/1989 Smith ..... 118/300
5,120,500 A 6/1992 Eggersdorfer et al. ..... 422/40
5,122,344 A * 6/1992 Schmoegner ..... 422/111
5,173,258 A * 12/1992 Childers ..... 422/27
5,213,619 A * 5/1993 Jackson et al. ..... 134/1
5,282,320 A 2/1994 Wedinger et al. ..... 34/12

FOREIGN PATENT DOCUMENTS

| | | |
|---|---|---|
| ES | 2125792 | 3/1999 |
| WO | 9003466 | 4/1990 |
| WO | 9104800 | 4/1991 |

* cited by examiner

*Primary Examiner*—E. Leigh McKane
(74) *Attorney, Agent, or Firm*—Baker Botts L.L.P.

(57) ABSTRACT

The device comprises an autoclave (1), a solvent tank or bottle (2), a tank (3) for gravity collection and cooling of the residual solution arriving form autoclave (1) for its later recovery, a dosification tank for concentrated reagent (4), dosed according to the weight of cellulosic material treated, a tank (5) which is connected by quick sockets to the system in order to recharge tank (2), a compressor unit (C), a refrigeration system (R) and a vacuum pump (8). The described system is controlled by a programmable robot aided by a screen on which are selected the stages of the procedure and the type of procedure itself, according to the amount of cellulosic materials to be treated, forming a transportable unit, and to a certain extent a portable one.

60 Claims, 10 Drawing Sheets

DEVICE AND METHOD FOR MASS DEACIDIFICATION, ELIMINATION OF FREE ACIDITY AND DISINFESTATION OF CELLULOSIC MATERIALS

CROSS-REFERENCE TO RELATED APPLICATIONS

This application is a national phase application of International Application No. PCT/ES00/00188, which was filed on May 26, 2000 and which published in Spanish on Dec. 7, 2000, which in turn claims priority from Spanish Application No. P 9901152, which was filed on May 27, 1999.

SCOPE OF THE INVENTION

The present invention relates to a device and method for mass deacidification of cellulosic materials, with simultaneous elimination of free acidity and disinfestation of the treated matter, specifically designed for conservation and treatment of books, documents, newsprint, maps, cellulosic fabrics and graphic work on paper, which provides a great efficiency in both safety and quality, as well as significant energy savings and a greater degree of automation as it incorporates an robot which controls the process and a display which allows to view its development.

The device and method of the invention are particularly well suited for solving the problems of libraries and archives holding documents of a certain age, preferably from the end of the 18th Century to the year 1960, specifically to conserve and preserve these, obtaining an adequate durability over time.

BACKGROUND OF THE INVENTION

The problems suffered by libraries and archives holding ancient documents are mainly centred on their conservation and preservation, in order to achieve their durability over time; these conditions are not satisfied in almost any library or archives, so that more expedite actions are required aimed at a suitable restoration.

As most restoration methods are manual, they are slow and expensive. The cost of C=restoring damaged books and documents can be prohibitive, except for incunabular manuscripts or rare volumes which are priceless for documentary, aesthetic or historical reasons.

One of the most pressing problems in conservation of paper in books and other cellulosic materials (fabrics, documents, newsprint, etc.) is the acidity of the paper, which is a result of the nature of paper obtained from cellulosic fibres obtained from wood with additives such as alum or resin, and the action of external agents such as heat, acidic pollutants, ozone, high humidity and temperatures. Acidity is one of the culprits of paper destruction. Thus, as of a decade ago, research has been conducted in developing mass deacidification methods to save large document records which are endangered by the acidic paper problem suffered mainly by late 18th Century, 19th and 20th Century paper.

Mass deacidification methods previously tested coincide in their objective of reducing costs with results which are different from those obtained by manual restoration. An hourly wage for a restorer's work in Spain is between 1,800 and 2,000 Pta. in official restoration centres, while a 500 page book requires approximately 70 hours, plus another 15 for sewing and binding. Therefore, a restorer-binder working 1,750 hours a year using odd moments to bind can restore about 20 books a year (between 175,000 and 158,000 Pta./book). These figures make a global restoration policy unviable.

Certain mass deacidification methods have been developed, but it can be said that none of the techniques offered fully satisfies the recommended quality criteria, such as preselection of the material to be restored, predrying, duration of the treatment, effect on ink, colours, covers, neutralisation of the paper acidity, final pH, alkali reserve, health risks to operators and readers, environmental impact, cost of the equipment and cost of treatment.

The present state of the art is described among other documents in Patent application PCT WO 90/03466, by the Lithium Corporation of America, which describes a mass treatment method for cellulosic matter which comprises deacidification of the paper, consisting of placing the paper in contact with solutions in hydrocarbons or halochlorocarbons of certain magnesium methoxy- and butoxy-polyethyleneglycols treated with carbon dioxide to provide low viscosity solutions which are more stable with humidity.

In an article by Dr. Robert S. Wedinger in Restaurator, Vol. 12, pp 1–17 (1991), a mass deacidification technique is described which consists of developing a number of compounds for simultaneous deacidification and strengthening of paper. The specific compound employed is carbonated magnesium butoxytriglycolate (MG-3) which neutralises the acidic components of paper. This process was discontinued in 1997 among other reasons due to the slow diffusion of the reagent and interactions between glycols and cellulose (R. Areal, J. M. Gibert and J. M. Dagá, The Effect of Aqueous Solutions of Alkoxypolyethylene glycols on the Mechanical Properties of Paper; communication in the Interim Meeting of the ICOM-CC Working Groups 20–22 April 1998. Graphic Documents. Stugard. Ludwisgsburg, Germany; and R. Areal, J. M. Gibert and J. M. Dagá, The Effect of Aqueous Solutions of Alkoxypolyethylene glycols on the Mechanical Properties of Paper, in the journal Restaurator, 19, 187–211, (1998). These reagents are not related to the invention described hereunder. They have been tested in the inventor's laboratories and an increase in cellulose volume has been shown to take place due to elimination of hydrogen bridges in the cellulosic material, and swelling of the pages, with an increased page thickness when measured with a micrometer. Tensile strength is also reduced with the accelerated aging of the paper, so that the results obtained from using these reagents are not too reliable.

In an article by Peter Schwerdt, in Sauvegarde et Conservation, Actes des Journées Internationales d'Études de l'ARSAC, Paris 30 Sep.–4 Oct. 1991, pp 213–216, a mass deacidification system is described for the Deutsche Bibliothek of Leipzig, comprising the following treatment stages for acid books and papers: predrying, deacidification, drying.

Patent application PCT WO 91/04800 (FMC Corporation) and U.S. Pat. No. 5,282,320 (Wedinggwe et al.) describe a machine with a size implying that it cannot be moved, as a book factory, lacking means for efficient dosing and double treatment autoclaves.

U.S. Pat. No. 5,120,500 (Batelle Institute) describes a process for non-polluting deacidification of books and other paper and printed matter of a size similar to that of the FMC design, so that it is a restoration installation comprising a predrying process for these products using high frequency radiation in a vacuum, treatment with solutions for deacidification and later elimination of solvents by vacuum drying with high frequency radiation again. This last type of predrying and final drying have been replaced by conventional means employing heat and vacuum due to the alterations of book pages caused by microwaves, as a result of the mobility of metal particles attached to the surface of the pages. It employs hexamethyl-disiloxane as a solvent and an adduct formed by magnesium ethoxide and titanium ethoxide as deacidifying agents. Predrying time is not indicated. The system is not globally related to our invention.

Patent GB 1,582,265 (Batelle Ingenieurtechnik) describes a process in which aged, damaged and fragile paper is treated with a solution containing isocyanate or isocyanate vapour, preferably using isocyanate with two or more isocyanate groups. This system is not related to out invention.

A publication by James Stroud, The Paper Conservator, Vol 18, 57–70, (1994), describes a deacidification process using diethylzinc (DEZ) which requires a 5-stage treatment: dehydration, impregnation, stabilisation, rehydration and post-treatment at 1 atm. The first two stages take place in a vacuum chamber; the rest of the process takes place at atmospheric pressure, and the entire process may last up to 5 days. Currently, the DEZ project is not in service and although work is being carried out to solve its inconvenients, persons in charge of the project do not expect it to be operational until the year 2003.

In the book "BOOK PRESERVATION TECHNOLOGIES", U.S. Congress, Office of Technology Assessment. Washington, D.C.; U.S. Government Printing Office, May 1988 are described several different problems and solutions related to this topic.

A further process with a certain reliability is Bookkeeper from Preservation Technologies, Inc., which uses magnesium oxide with particle size between 0.2 and 0.9 microns and a surfactant acting as a dispersant of the magnesium oxide in the solvent, with perfluoroheptane as solvent. The process consists of a pre-treatment, impregnation and post-treatment. This last procedure is without a doubt one of the most promising ones currently due to the successive evaluations and revisions made on it; the experience of its researchers show that this process, as it employs a micro-dispersion of magnesium oxide whose a transverse penetration in the paper depends of the number of loops of the magnesium oxide, in glossy paper the oxide particles remain on the surface and have little penetration into the paper, as indicated in the examples of an application of the method disclosed by the inventors in patent application PCT WO 00/08250. Preparation of the magnesium oxide and its application are described in U.S. Pat. No. 4,522,843.

The pioneering process is the Canadian Wei T'o, which gives good pH results but not so good results for homogeneity of the alkaline reserve, which due to the low solubility of the reagents in methanol produce side effects on inks; the alkaline reserve which remains in the paper after the process is relatively low, so that after a generally short time it is again necessary to deacidify.

The Sablé process is a variation of the Wei T'o method; its disadvantages is that printed ink will run and white dust is deposited on the bindings. The total alkaline reserve and its distribution is unsatisfactory.

Among the antecedents in the state of the art is also Spanish Patent No. ES 2,125,792, in the name of the applicant, which relates to a device and method for mass deacidification disinfestation and disinfection of documents and books, employing a solution of a reagent and a suitable solvent HFC R134a; reagents are methoxy and butoxy polyethyleneglycolate magnesium carbonates, which reagents are very similar to those used by the Lithium Corporation of America, but as they were shown to give unsatisfactory results they were discarded after their application in the patented device and replaced by other products. Spanish patent application P9700964 in name of the applicant is a modification of Spanish Patent No. ES 2,125,792.

The above method presents difficulties in the impregnation stage due to an impregnation time of 3 hours, but as the solvent distillation stage takes place in the same autoclave, during said distillation a time increase takes place on the order of 4 to 6 hours depending on the amount of solvent; this defect may not be corrected in this method.

SUMMARY OF THE INVENTION

The object of the invention is to disclose a method for mass deacidification, elimination of free acidity and disinfestation which considers environmental factors, that is, which operates in a closed circuit with non-polluting reagents and solvents, complying with the Montreal Protocol and meeting as many conditions as possible for mass deacidification.

In order to attain this objective the device disclosed comprises an autoclave meant to contain the cellulosic materials to be treated, a solvent tank placed above a loading cell which allows to program the amount of solvent for each specific process, a concentrated reagent dosage tank to add the right amount of reagent depending on the weight of cellulosic matter to be treated and a gravity collection tank for the residual solution form the autoclave for later recovery.

Additionally, the method disclosed by the invention includes the use of said device and comprises drying or dehydration of the cellulosic matter in the autoclave chamber, dosage of an active deacidifying product, impregnation of the cellulosic material by contact with a solution of the active deacidifying product in the autoclave chamber, drainage under gravity of the residual solution from the autoclave to the residual solution tank and recovery of the solvent by distillation of the residual solution with transfer of the distilled solvent from the residual solution tank to the solvent bottle.

DETAILED DESCRIPTION OF THE INVENTION

1. Equipment

Figure 1:
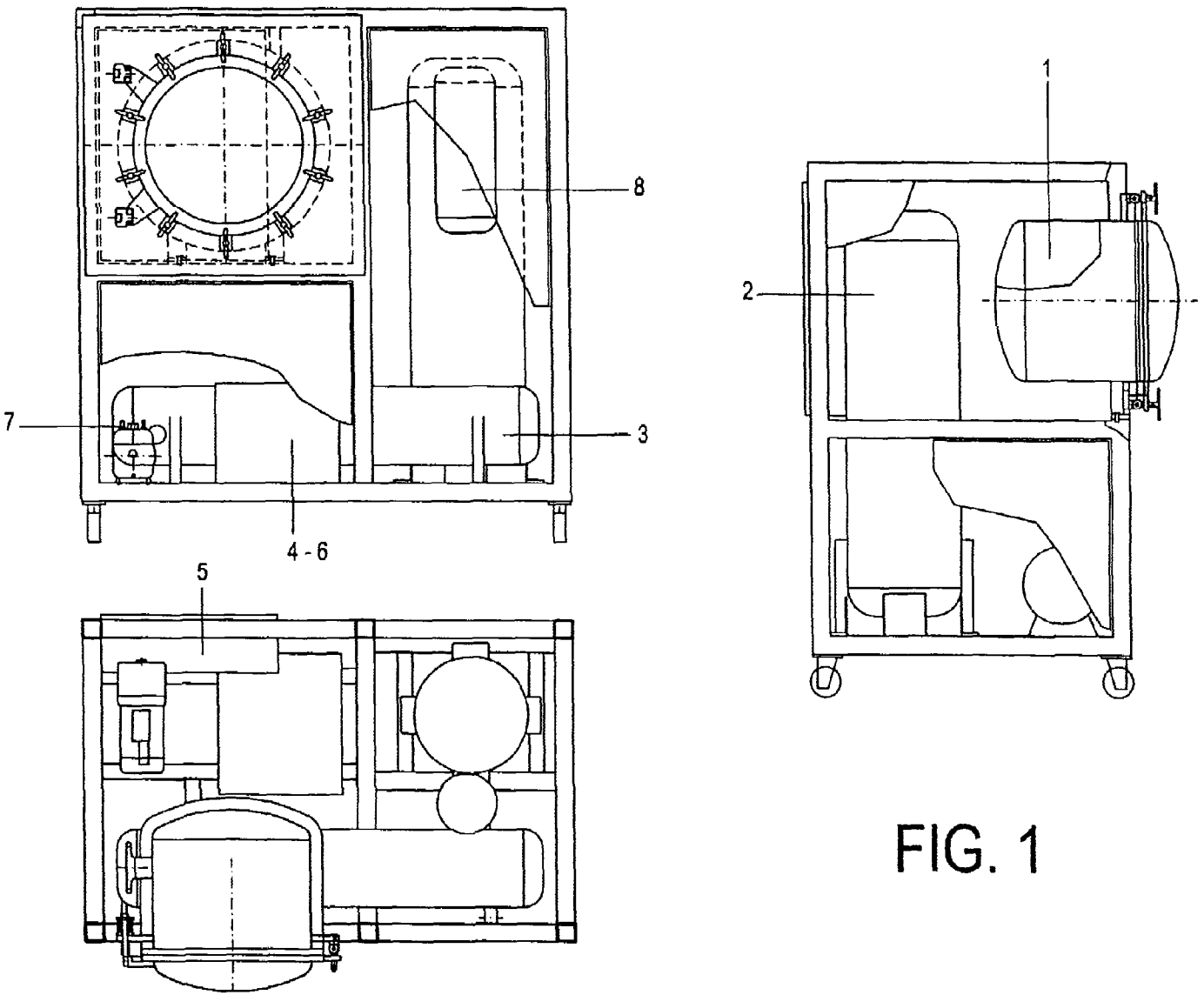
FIG. 1 is a front elevation view, a side elevation view and a top plan view of a machine containing the device object of this invention.

Firstly, the invention provides equipment for the mass deacidification, elimination of free acidity and disinfestation of cellulosic materials; in continuation the invention equipment, which comprises an autoclave (1) with pressure and temperature control into whose interior the cellulosic materials to be treated are introduced. A series of chemical and physical processes are then carried out which produce physical and chemical changes in the substrate of the aforementioned cellulosic materials; a solvent bottle (2) connected to the autoclave (1); a charge cell (13) on which the solvent bottle is placed (2) and which serves to program the quantity of solvent in each process; a dosification tank (8) of concentrated reagent to put in the appropriate quantity of the reagent according to the mass of material to be treated, characterised by having a gravitational collection container (3) for the residual solution coming from the autoclave, (1) for its subsequent recovery.

In a specific embodiment, the autoclave (1) comprises a body, for example, cylindrical, and a cover with an airtight joint, a pressure sensor, a safety valve, a temperature control thermocouple in the interior of the autoclave (1), a system for measuring the pressure and the vacuum, an external temperature control and heating bands on the outside wall of the autoclave (1).

The solvent bottle (2) contains the solvent and has an external refrigeration system, which, in a specific embodiment, consists of a refrigeration unit made up of a hermetic compressor (C), a condenser and a refrigerated jacket which wraps around the upper section of the solvent bottle (2). In this case the invention equipment could include a de-icing system to eliminate the ice which forms on the jacket covering the solvent bottle (2) which forms during the distillation process. In a specific embodiment, this de-icing system consists of a fan (V) driven by a motor (M) and a heating resistance (R). The previously mentioned refrigerating jacket which wraps around the upper part of the solvent bottle (2) may have a valve for the automatic outflow of condensates.

The solvent bottle (2) also has a heating system (10).

The dosification tank (8) for concentrated reagent is a container which holds the concentrated deacidification reagent and is connected to the autoclave (1) in such a way that the appropriate quantity of the concentrated reagent can pass directly to the autoclave (1), where it will later reach the desired final concentration by pouring solvent directly from the solvent bottle (2) to the interior of the autoclave (1). In this case, the autoclave (1) has a solvent and concentrated reagent input line which is either connected to the concentrated reagent dosification tank (8) or to the pure solvent bottle (2).

The gravity collection tank (3) for the residual solution coming from the autoclave (1) allows the collection of this residual solution for later recovery. This tank (3) has a refrigeration system (14) that it uses during the emptying of the autoclave (1).

The residual solution collection tank (3) also has a heating system (14) used to distil the solvent contained in the residual solution.

In a specific embodiment of the invention equipment, The residual solution collection tank (3) has an input for a cleaning product, for example anhydrous n-propanol, or air.

The residual solution collection tank (3) also has an evacuation valve (VM7) for the suspension formed after the distillation process.

The connection between the autoclave (1) and the residual solution collection tank (3) is opened or closed by means of a manual or automatic valve (NV5, VM6).

The invention equipment may also include a vacuum pump connected to the autoclave (1), a loading cell (11) on which is placed the dosification tank (8) for the concentrated reagent, a programmable robot for the automatic control of the equipment processes and a touch screen from which the type and steps of the process to be taken are selected, according to the quantity of material to be treated.

The invention equipment may include different types of valves, for example:

- a series of pneumatic valves that, in a specific embodiment, could be controlled by the robot and operated through the touch screen linked to the robot;
- a set of electro-valves that open or shut the passage in different stages of the process; and
- a series of manual valves related to the maintenance, the holding of liquids or the entry of reagents and solvent.

The invention equipment also has the possibility of the availability of a recharging bottle (12) coupled to the system to refill the solvent bottle (2) in the face of losses which may be produced in the course of the process.

The invention equipment may have, as a safety precaution, a safety valve in the upper section of the solvent bottle (2), a safety valve in the upper part of the residual solution collection tank (3), and, optionally, a safety valve in the upper section of the autoclave (1).

The invention equipment may also include a filter with a humidity absorption indicator in the solvent bottles connection tube (2) with the rest of the system, as well as a heat exchanger (6) which optimises the refrigeration of the solvent bottle (2) and makes use of the heat produced to heat the residual solution collection tank (3).

2. Procedure

In another aspect, the invention provides a procedure for the mass deacidification, elimination of free acidity and disinfestation of cellulosic materials. In continuation is the procedure of the invention, by use of the equipment of the invention, which has the following stages:

- drying or dehydration of the cellulosic material in the autoclave chamber;
- dosification of an active deacidifying product;
- impregnation of the cellulosic material by contact with a solution of the active deacidifying product in the autoclave chamber;
- Emptying be gravity pouring the residual solution from the autoclave to the residual solution tank; and
- solvent recovery by distillation of the residual solution with the transfer of distilled solvent from the residual solution tank to the solvent bottle.

The drying or dehydration of the cellulosic material to be treated is carried out in the autoclave chamber by intermittent cycles of evacuation and the entrance of preferably hot air. To carry out this stage the air is allowed to penetrate into the autoclave chamber and, once it has been introduced, it is heated for the period of time necessary for it to reach a determined temperature, 50° maximum, so as not to damage the material under treatment, increasing the pressure inside the autoclave due to the temperature increase and the closure of the vacuum pump valve. The evacuation cycle is carried out by means of a vacuum pump and a pressure sensor until a vacuum of 30 to 40 millibars is reached. The last cycle in a series of drying or dehydration cycles is a vacuum cycle which leaves the autoclave under a vacuum, used to force the entry of the reagents during the dosification phase.

The number of vacuum and air entry cycles is a function of the mass of the cellulosic material. In general, in an autoclave with a volume of around about 80 liters (l), preferably between 10 and 50 vacuum and hot air entry cycles are carried out around 8 minutes to dry or dehydrate a mass of approximately 20 to 60 kilograms(kg) of cellulosic material.

Once the drying or dehydration stage is finished, the humidity of the cellulosic material is understood to be between 2% and 2,5%.

The drying or dehydration procedure used in the invention process is faster than any of those used in other similar processes since at atmospheric pressure and even at lower pressures, in the order of 30 millibars, the thermal conductivity of water vapour is much higher than at high vacuum, at which conventional systems work. This type of dehydration process, based on intermittent vacuum/hot air entry cycles, also has some clear distinctions from the conventional systems, given that some of them use high frequency currents. These had to be abandoned owing to the damage caused by the metallic particles within the cellulosic material, or even because of the materials used in the machinery construction.

The dosification stage of the active deacidifying product is divided into two sub-stages, (i) a concentrated reagent entry stage, in a specific quantity, from the dosification tank to the lower part of the autoclave, under the action of a vacuum generated in the autoclave in the last drying cycle, in such a way that the concentrated reagent does not come into contact with the cellulosic material; and (ii) a dilution stage of the concentrated reagent to a determined concentration. The active deacidifying product may be any appropriate substance for deacidifying the cellulosic material, optionally accompanied by a suitable carrier. In a specific embodiment, the active deacidifying product is the carbonate of magnesium di-n-propylate, diluted in HFC 227 and a small quantity of n-propanol.

The reagent concentration in the dosification tank may vary over a broad range, preferably between 50% and 70% by weight of pure reagent.

The concentrated reagent entry stage into the autoclave consists in passing a specific quantity of the aforementioned concentrated reagent from the dosification tank to the lower part of the autoclave.

The reagent dilution stage consists of allowing a specific quantity of solvent to pass from the solvent bottle to the autoclave. In a specific embodiment, pouring of the solvent from the solvent bottle to the autoclave is carried out assisted by heating the bottle by means of a heating system, with the aim of encouraging the flow of the solvent to the autoclave.

The quantities of concentrated reagent and solvent added to the autoclave are determined as a function of the final concentration of the reagent required, and it is added automatically by means of loading cell pathways on which the concentrated reagent and solvent tanks, respectively, are found. In a specific embodiment, the concentration by weight of the pure reagent after dosification is understood to be between 2.0% and 4.5%, according to the pH of the cellulosic material under treatment. The reagent solution can be programmed by means of loading cells operated by the robot from the concentrated reagent, in order to obtain the previously stated concentrations, which are the most appropriate to provide the paper with alkaline reserves understood to be between 1% and 1.5%. The programming which is carried out as a function of the quantity (kg) and acidity of the cellulosic material under treatment.

Once the necessary reagents have been added to the autoclave the impregnation of the cellulosic material under treatment stage begins, by contact with a solution of the active deacidifying product in the autoclave chamber. In general, impregnation stage lasts for up to 3 hours according to the weight of the cellulosic material. In this period of time an homogeneous distribution is achieved in the interior of the cellulosic material under treatment, in particular, in the pages of books.

The large duration of this impregnation stage is owing to the fact that the carbonate of magnesium di-n-propylate used is less reactive than the magnesium di-n-propylate, but this apparently inconvenient time loss is compensated for by the advantage that because it is a slower reaction, the diffusion is more homogeneous and white marks are not produced on the covers, as occurs in processes that use more powerful reagents.

The evacuation stage of the residual solution is carried out on completion of the impregnation stage by pouring from the autoclave to the residual solution tank not only by gravity but also by cooling the residual solution tank. Evacuation of the autoclave is also favoured by its heating.

The residual solution remaining after the treatment of the cellulosic material contains sludge and solvents, mostly HFC 227. This residual solution may contain a small quantity of spine finishing glues, particularly those after the 1960's, as they are synthetic, magnesium salts, as well as sulphates, chlorides and nitrates and small quantities of n-propanol, besides the dirt of the books that is extracted by the solvent, for example, the HFC 227. These products are deposited at the end, or are dissolved.

The liquids under pressure go to the collection tank by gravity and cooling of the system with the system compressor by means of the heat exchanger by opening the corresponding pneumatic valve. Because of this the aforementioned tank is situated in the lower part of the machinery, which includes the invention equipment.

Once the autoclave is evacuated, the corresponding pneumatic valve is closed so that the vapour of the tank does not flow back towards the autoclave again, at the same time that the residue collector tank is cooled by means of the heat exchanger with the compressor unit.

Once the pouring of the residual solution to its tank has taken place, the cellulosic material is collected from the autoclave chamber.

To follow, we go on to the recovery of the solvent by the distillation of the residual solution evacuated from the autoclave during the evacuation stage, with transfer of the distilled solvent from the residual solution tank to the solvent bottle. The distillation is carried out by heating the residual solution tank and leading the vapour to the solvent tank and cooling the tank to recover the solvent.

For the distillation process to be more efficient, recovering almost all of the solvent used as a diluent, the residual liquid collection container is heated by means of a heat exchanger, once the compressor-refrigerator unit, which cools the distillate reception tank is set into operation [that is, the solvent bottle (2)]. When distillation starts, the treated books are removed from the autoclave chamber and a new batch of books may be put in for dehydration and treatment. Both processes are simultaneous, the duration of the distillation being between 4 and 6 hours, depending on the volume of the solvent used. The drying operation of the cellulosic material takes between 4 and 6 hours, also according to the quantity (kg) of books to be treated, a time which is the same as that of the distillation process. This implies a reduction in total time of the procedure of the invention since both operations may be carried out simultaneously. This means that the total time of the process of the invention is of the order of 9–10 hours in the case of the largest volume of solvent and the greatest quantity of books. As a summary, in a specific embodiment, the distillation process is carried out simultaneously with the drying or dehydration procedure of a new batch of cellulosic material to be treated.

Secondly, to effect solvent recovery after treatment, using condensation into the corresponding container [solvent bottle (2)], it is subjected to exterior cooling by means of the refrigeration system unit and heating of the solution residue collection tank to totally recover the solvent HFC 227. This may be achieved, for example, when the absolute pressures of these tanks are equal to 1.5 bar.

Periodically it becomes necessary to clean the residual solution collection tank, where non-volatile products accumulate which then remain after the distillation process. Among these products is n-propanol, which has a very low vapour pressure in relation to the HFC 227, because of which it cannot be distilled, but a small quantity is carried over during the distillation process without harming subsequent operations, given that most of it is retained in the filter cartridges (F1), which are interchangeable. To clean the aforementioned tank an opening to the tank from the manual input valve has been provided for the introduction of a cleaning product, for example, n-propanol, and then air is bubbled in to stir and disperse the solid material from the end of the container, giving rise to a suspension that may be eliminated through the evacuation valve of the tank, for example, through a manual valve at the end of the tank.

The invention process contemplates the possibility of checking for possible loss of weight n the solvent bottle, after a series of processes have been carried out, and the possibility of refilling the solvent if necessary, using an exterior tank that is connected to the aforementioned bottle, in places previously designed for that purpose.

The invention process also includes the possibility of achieving the disinfestation of the treated cellulosic material by an additional process, in which case this disinfestation stage may take place simultaneously with the drying or impregnation phase. The disinfestation phase consists of the creation of a vacuum in the autoclave and the introduction of an appropriate desinfestant, for example, nitrogen, carbon dioxide or HFC 227. This agent must be allowed to act for a period of time which is enough to eliminate the larvae and insects through lack of oxygen. In a specific embodiment, the disinfestation stage lasts between 4 and 6 hours and includes the use of gases at pressures of up to 2 bar.

The possibility of checking the functionality of the system provided by the invention has also been foreseen. To do this, in a specific embodiment, the invention process has a result control stage at the end of the procedure. The result control may be carried out by the determination of the distribution of the magnesium (magnesium carbonate) in the treated material before and after treatment. Transverse cuts can be made to see the distribution of the magnesium particles over the length of the cut, using a scanning electron microscope (SEM), and by quantitative determination and identification using electronic microprobe scanning detection and pH determination using a plane electrode on different parts of the page using random sampling. In a specific embodiment, by evaluation, it has been determined that the alkaline reserve reached in the different sections of a book could be between 1% and 1.5%.

The invention process contemplates the possibility of automatic control by means of a robot.

In agreement with another of the characteristics of the invention, it has been foreseen that the autoclave chamber where the dehydration is carried out may be used to recover library books or archive files that have experienced water or fire damage causing the pages to be stuck together.

3. Drying Procedure for Cellulosic Material

The invention also provides a cellulosic material drying procedure that uses the invention equipment, and in which drying of the cellulosic material is carried out by means of intermittent cycles of evacuation and entry of hot air. For this, after the entry of the air it is heated for the amount of time necessary to reach a temperature of 50° C. as a maximum, increasing the pressure within the autoclave because of the temperature rise. The evacuation cycle can be carried out using a vacuum pump and a pressure sensor until a vacuum of between 30 and 40 millibars is reached. The number of vacuum and air entry cycles is a function of the mass of cellulosic material to be dried.

4. Use of the Equipment and the Invention Procedure

In another aspect, the invention refers to the use of the invention equipment and the invention procedure for the treatment of cellulosic material, in general, and, in particular, books or any other type of publication on paper.

5. Specific Achievements of the Invention Equipment

To follow some of the specific achievements of the invention equipment are described, reference being made to the figures accompanying the description. FIG. 1 shows a machine that includes an equipment of the invention, which covers an autoclave (1);

a solvent bottle (2) refrigerated/heated, provided with a jacket in which the solvent is stored, for example HFC 227; the heating is carried out by electrically supplied heating elements while the refrigeration is achieved using a compressor refrigerator;

a residual solution collection tank (3) for the materials coming from the autoclave (1) by gravity, for the recovery of solvents by means of opening the pneumatic valve (NV5), activated by compressed air and on an automated program; the liquid and the neutralised free acids, as well as the solvent and the unconsumed reagent go down from the autoclave;

a compressor unit (4) made up of a refrigerator—refrigerator with the aim of leading the solvent by distillation from the tank (3) to the solvent bottle (2), through cooling of the refrigeration jacket by the action of a condenser;

an electric board (5);

a condenser (6);

a vacuum pump (7) to apply the vacuum for drying the books; due to the low thermal conductivity produced in the autoclave (1) at high vacuums and the fact that heating plates are not used inside the autoclave, there has been recourse to cycles of evacuation and entry of air, which is allowed to heat up on coming into contact with the hot surface (40–45° C.) of the autoclave, (1) which effects a vacuum of between 30 and 40 mbar, achieving a more rapid dehydration of the cellulosic material, in the order of 4 hours for 20 kg of books in 30 cycles; 5:30 hours for 30 kg of books in 40 cycles; and 6:30 hours for 50 kg of books in 50 cycles; the cycles are regulated by means of a robotic program incorporated into the system;

a dosification tank (8) that contains the concentrated deacidifying reagent, situated on a loading cell (11) to obtain an adequate dosage for the program.

Figure 2:
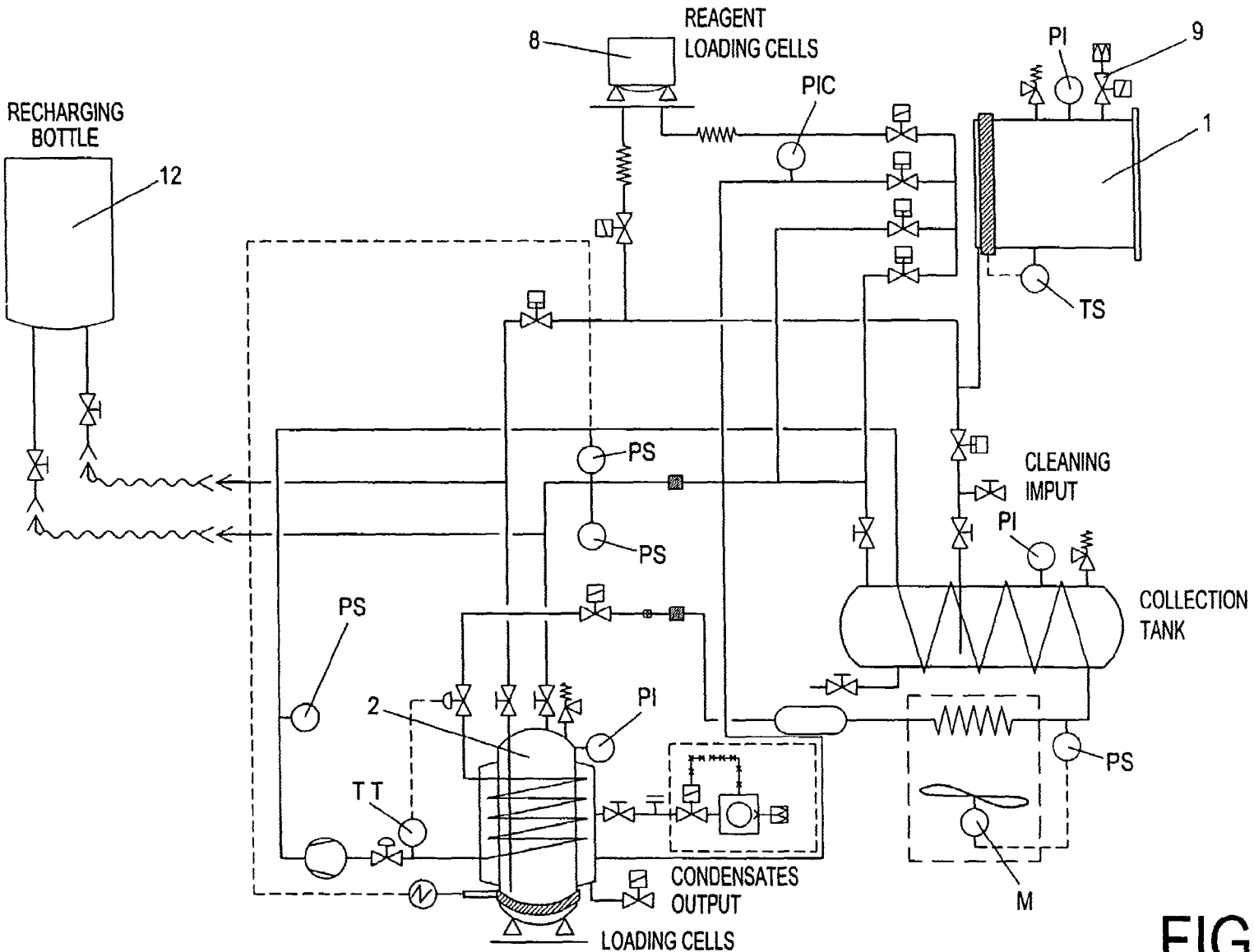
FIG. 2 shows a specific embodiment of a device according to this invention with its components.
Figure 3:
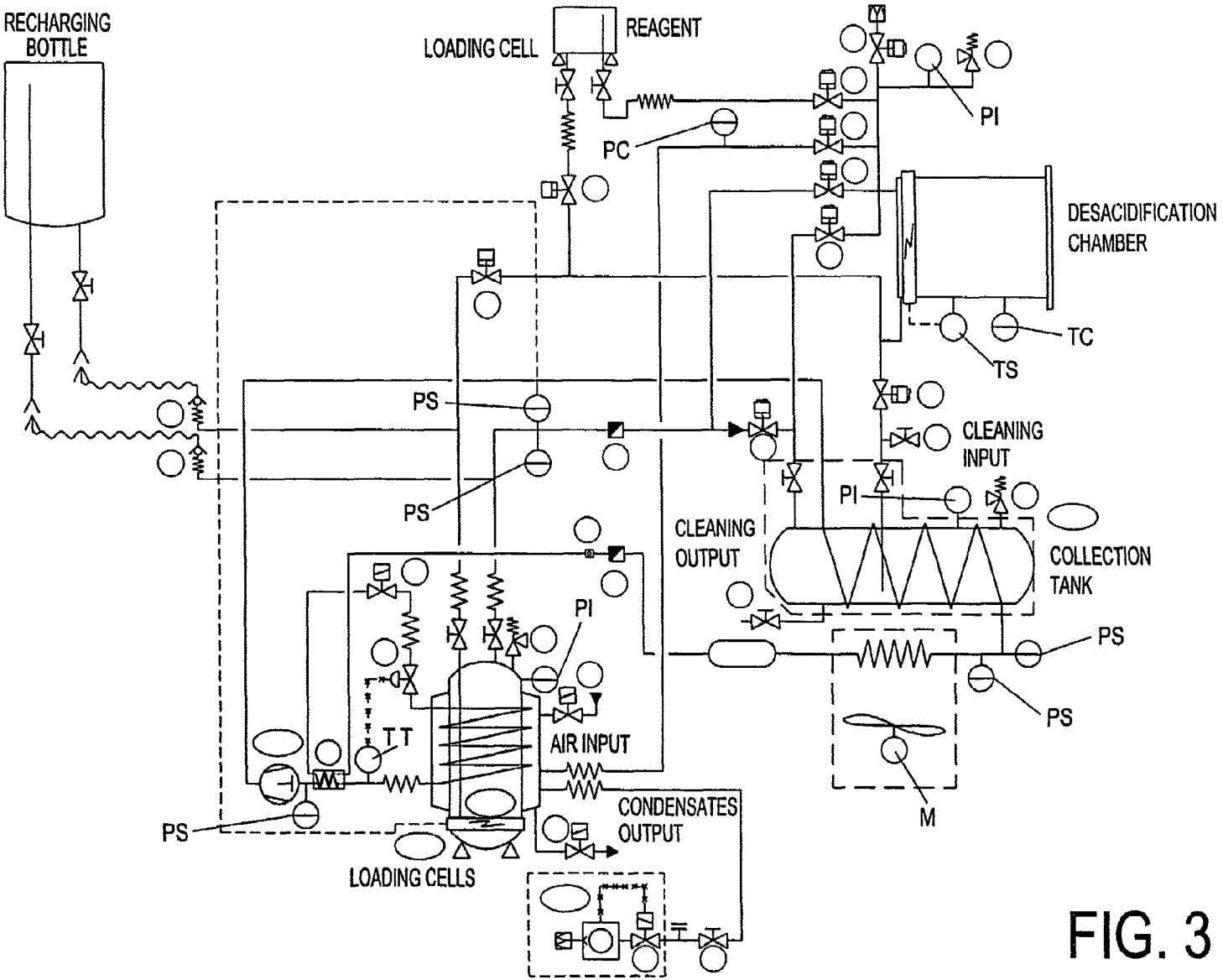
FIG. 3 shows a specific embodiment of a device according to this invention with its components identified by DIN and ISO Standards for components (filters, electrovalves, etc.).
Figure 4:
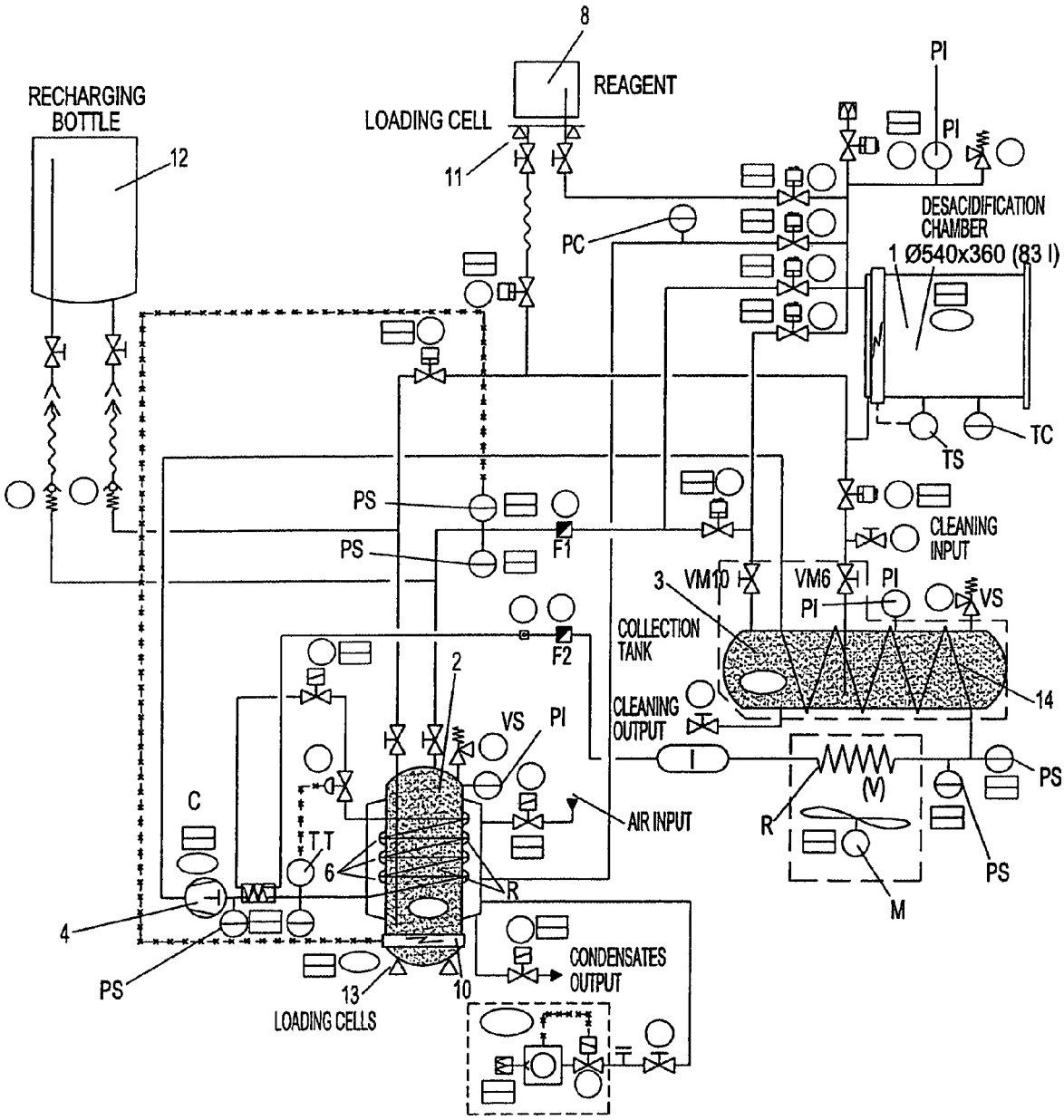
FIG. 4 shows a specific embodiment of a device according to this invention with its components, similar to that of FIG. 2 but with a different embodiment.

FIGS. 2–4 show some of the specific achievements of the equipment provided by this invention with the equipment components in their assembled positions, with the symbols that follow the ISO and DIN standards for the identification of the machine components. These symbols are attached as addenda to FIG. 4.

In a specific embodiment, the invention equipment includes an autoclave (1) whose chamber is joined to a safety electrovalve (9) with an outflow valve to the atmosphere. In a specific embodiment, the chamber is of a cylindrical form having dimensions 540×360 (83 liters capacity) and is able to withstand a maximum pressure of 10 bar. The dimensions may vary according to the design and the volume needs. The autoclave chamber has a heating system made up of heating bands covering part of the wall of the autoclave (1). It likewise has an external programmable temperature control sensor (TS), while in its interior there is another thermocouple (TC), to ensure that the temperature of the books does not exceed 40° C.–50° C. It also has a pressure and vacuum sensor (PI). The autoclave (1) has a safety valve (VS) which is released when the interior absolute pressure exceeds 6 bar.

A double effect rotary vacuum pump (7), with an estimated flow of 8 $m^3$/h, allows achievement of more rapid dehydration of the cellulosic material before treatment.

In a specific embodiment the solvent refilling bottle (12) coupled to the system to refill the solvent bottle (2) when losses may have occurred during the process has a capacity of 60 liters of HFC 227, a fluorocarbon solvent classified as ecological since it contains no chlorine to damage the ozone layer, and it is not toxic, in fact it is used in asthma sprays.

The solvent bottle (2) is surrounded by a refrigerating jacket on which a cooling compressor unit (4) acts which is in turn joined to a hand operated valve. In the connection conduit of the bottle with the rest of the system there is a filter inserted which has a humidity absorption indicator to purify the recovered HFC 227.

A system with a heating band (10) encircles the recipient to effect the heating of the solvent liquid (2) and to facilitate pouring from the autoclave.

A refrigeration unit with a power of 0,750 CV, and a yield of 865 Kcal/h at −10° C., made up of a hermetic compressor and a condenser (6) and a refrigerating jacket which wraps around the bottle containing the HFC 227 around its upper part, to condense the solvent.

The solvent bottle (2) is situated on a loading cell (13) which allows dosification of the solvent through a program according to the different recipes prepared as a function of the weight of the books and of the deacidifying reagent added from the dosification tank. The dosification of the solvent is controlled by weight.

The deacidification chamber is joined to a storage container (3) for the residual solution and from this solution the solvent is distilled to the solvent bottle (2) to start another work cycle. In a specific embodiment, this container (3) has a capacity of 90 liters, connected to the end of the autoclave (1) by means of a manual valve for cleaning operations; an electro-valve opens the evacuation circuit from the deacidification chamber to the distillation recipient when the impregnation time is finished of the reagent with the books contained in the deacidification chamber. The chamber can be opened after the treatment and emptied and in this way a rapid drying of the treated books can be carried out.

A dosification tank (8), placed on loading cell (11), allows, through opening manual valves and an electrovalve by a program dosification of the reagent, whose composition is measured in the aforementioned container. Then, after the entry of the reagent into the chamber, a solution is made with the solvent that goes directly to the chamber from the solvent bottle (2).

List of the invention equipment components according to FIG. 4:

Autoclave (1).

Solvent bottle (2) with jacket, safety valve, VS and joined a heating band and refrigeration coil connected to the compressor unit and with a pressure indicator PI and mounted on a loading cell (13).

Residual solution collection tank (3) with a 90 liter capacity, provided with a cooling and heating coil, safety valve VS and pressure indicator PI, connected to the heating and refrigeration system; it has the manual valves VM6 and VM10.

Dosification tank (8) of the concentrated reagent for feeding the autoclave (1) with active concentrated reagent, situated on a loading cell connected to the robot to dose the reagent according to the volume of books; the manual valves VM3 and VM4 are joined to flexible tubes.

The reserve tank (12) of HFC 227 to replace losses, that is joined by means of quick plugs and using the appropriate circuit it sends HFC 227 to the bottle (2).

System made up of the compressor (4) and the condenser; this unit provides cold and, by inversion, generates heat; this unit manages the cooling of the different parts of the process of treatment of the books; this system has a fan activated by a motor (M) incorporated, that cools a system of flexible cable with a large surface area to optimise the cooling of the coils.

The system is provided with a series of pneumatic valves governed by the robot and activated by means of the touch screen linked to the robot. It also has a set of electro-valves (FIG. 4), which prevent or allow passage in different stages of the process. The system also has a series of manual valves incorporated, related to the maintenance, refilling of liquids, entry of reagents and solvent.

In different parts of the system it has pressure sensors PS and pressure indicators PI. There is also a pressure controller PIC.

Temperature regulators are interposed at different points of the process TS as well as temperature indicators.

All of the recipients of the system that have to withstand pressure are provided with a series of safety set to a pressure of 6 bar. The equipment is tested up to 10 bar absolute pressure to assure adequate safety.

The system has a heat exchanger to optimise the refrigeration cycle of the bottle (2) that contains the HFC 227 and to make use of the heat given off to warm up the tank (3).

FIG. 4 shows 2 filters marked F and F1. Their function is to absorb water and small quantities of n-propanol carried over in the distillation, and the filter F2 is to dry the refrigeration vapour.

6. Description of the Operation of the Invention Equipment

In FIG. 4 the nomenclature of the equipment components is presented, in which are shown the valves and their types:

the manual valves appear as VM (manual valves);

the electrovalves are those shown as EV (electrovalves);

the pneumatic valves are shown as NV (pneumatic valves).

E represents the system of connections using male and female tubes related to the pouring of fluids.

B Vacuum pump.

C Compressor unit to generate cold.

PS Pressure sensors.

PI Pressure indicators.

VS Safety valves.

TS Temperature indicators.

TC Temperature controllers.

M Ventilator motor to dissipate heat.

F Humidity, n-propanol and solid substance absorption filters.

Loading cell (8).

I Heat exchanger.

Heating by bands (10).

V Ventilation.

R Resistance.

Ri Refrigeration system.

The bottles, recipients and autoclave are appropriately numbered: autoclave (1), reception tank of the residual solution (3), bottle of HFC 227 (2), refill bottle of HFC 227 (12).

Using these assignations the operating diagrams of the machinery that constitutes the objective of this invention are interpreted. The numbers following each valve have been assigned to follow the figures that explain the operation of the machinery.

Figure 5:
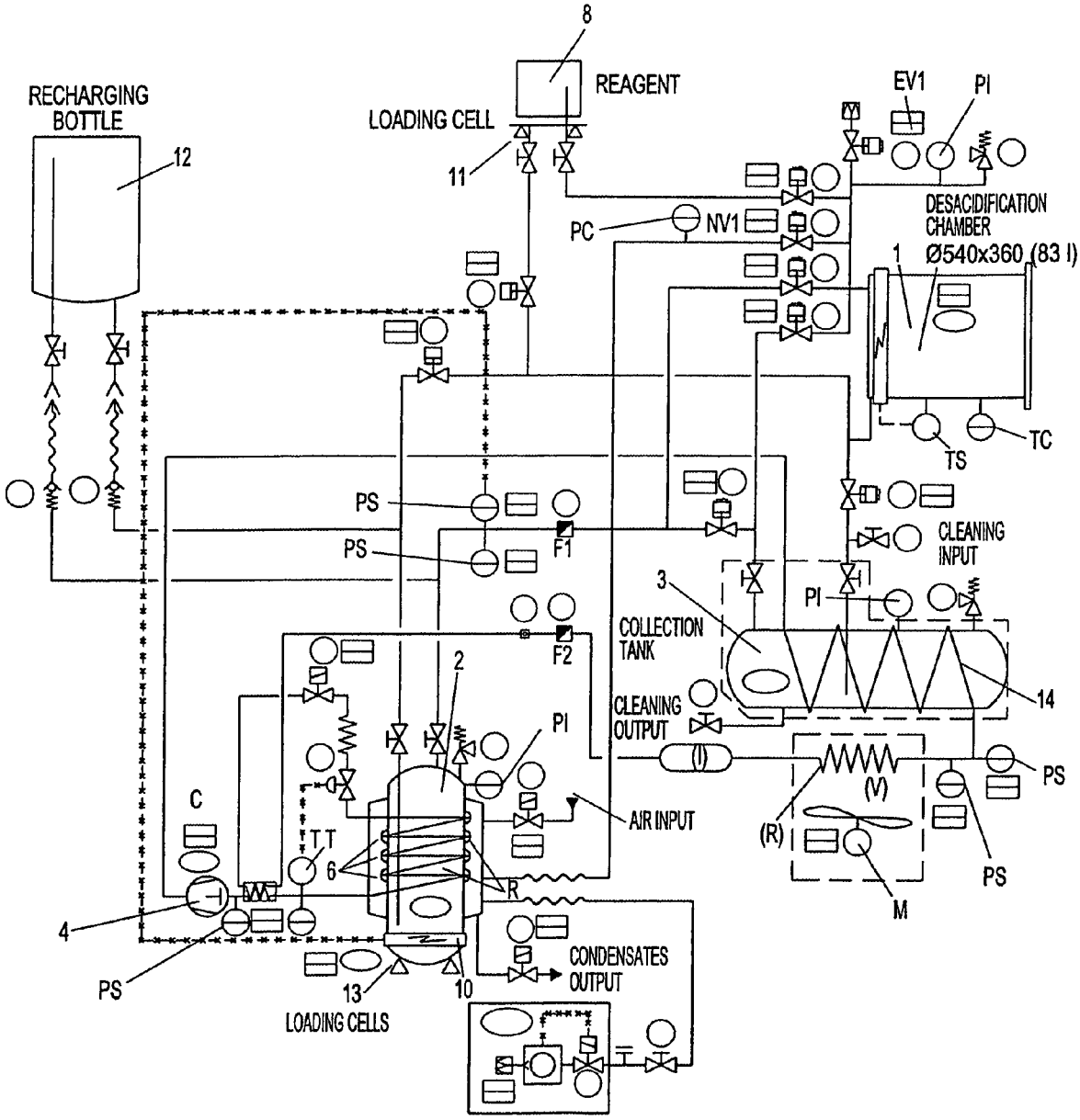
FIG. 5 shows a flow chart for the vacuum/air intake cycles.

The part of the process described in FIG. 5 is indicated by means of a continuous line, thicker in the schematic of the vacuum cycles. The operation is as follows: The electrovalve EV1 (electrovalve) is opened, activated by the robot incorporated into the machinery, and then the pneumatic valve NV1 is opened, which connects the vacuum to the autoclave (1), until 30 mbar is reached, or by default a time of 4 minutes has passed, to attain an adequate vacuum. Once this time has passed, the output of the autoclave is opened, to break the vacuum by means of the electrovalve EV1, which allows a current of air to pass from the atmosphere to the autoclave (1). The autoclave is at a temperature of 45–50° C., the air, once the electrovalve EV1 is opened and the electrovalve EV2 is closed, that disconnects the vacuum, is held for 4–5 minutes until the temperature of the autoclave reaches (45–50° C.). The electrovalve EV1 shuts automatically once 4–5 minutes have passed and electrovalve EV2 and the pneumatic valve NV1 open once again, and a new vacuum cycle is produced again. Successive openings and closures, allows the passage of an air current and a pressure of 1 bar is obtained in the dehydration autoclave (1), which is at a temperature of 45° C. The air is held in the chamber until this temperature is reached by an air residence time of about 4 minutes. Then, the vacuum pump B is connected by opening the electrovalve EV2, until 30–40 mbar is reached (some 3 or 4 minutes) and through the action of the programmed time EV2 closes to disconnect the vacuum produced by the pump and electrovalve EV1 opens again. The total time of the operation of this cycle is about 8 minutes. This cycle repeats 30 times to dehydrate 20 kg of books (4 hours). The number of cycles is 40 for 30 kg of books (5 hours and 20 minutes), and 50 for 40 kg of books (6 hours and 40 minutes). In this way dehydration of the paper is achieved, going from a humidity content of 6–7% to approximately 2–2.5%.

Figure 6:
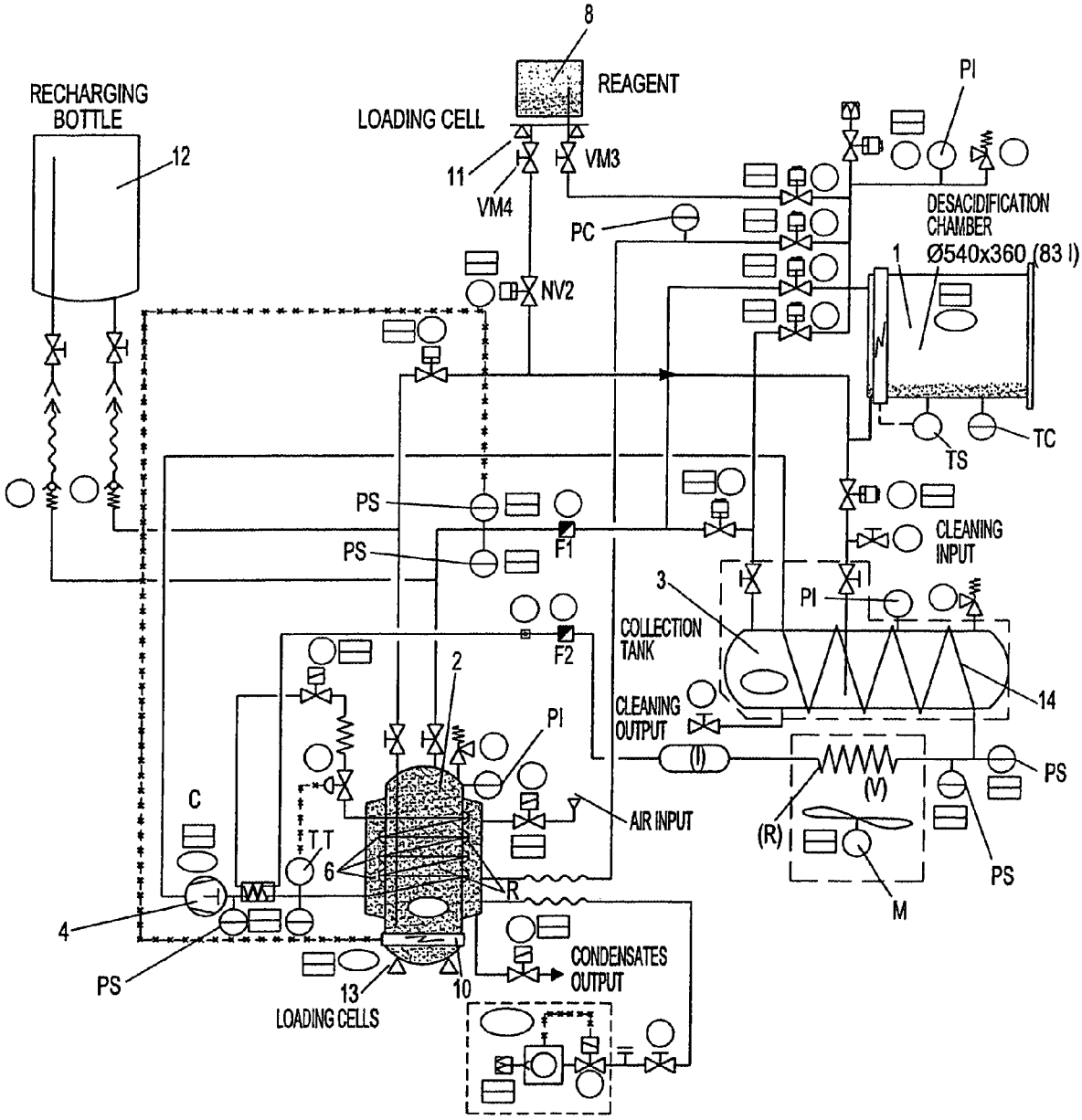
FIG. 6 shows the flow chart for the input cycles of concentrated reagent.

When the dehydration process of the books or documents is finished the material is ready for the impregnation stage. This stage (see FIG. 6) is characterised by the dosification of the concentrated reagent arriving from tank (8), situated on a loading cell (11); tank outlets with manual valves remain open, and opened by the program controlled by the robot is activated pneumatic valve NV2, allowing the deacidifying reagent to pass to autoclave (1). The reagent enters through the inlet of the bottom of autoclave (1), so that the concentrated reagent is not in contact initially with the matter to be treated, until it is diluted in solvent HFC 227. Dosification begins after the book dehydration ends. The amounts of reagent added are previously programmed and calculated depending on the weights of the book to treat. The calculation is performed according to the concentration of the deacidification reagent of tank (8), which depending on the batches and the prior factory analyses can be between 50–70% by weight. For about 20 kg of books and with a reagent concentration of 70% by weight, 800 g, of reagent 100% would be required by the books to reach an alkaline reserve of between 1% and 2% corresponding to 1,150 g of concentrated solution, which is programmed into the robot.

Figure 7:
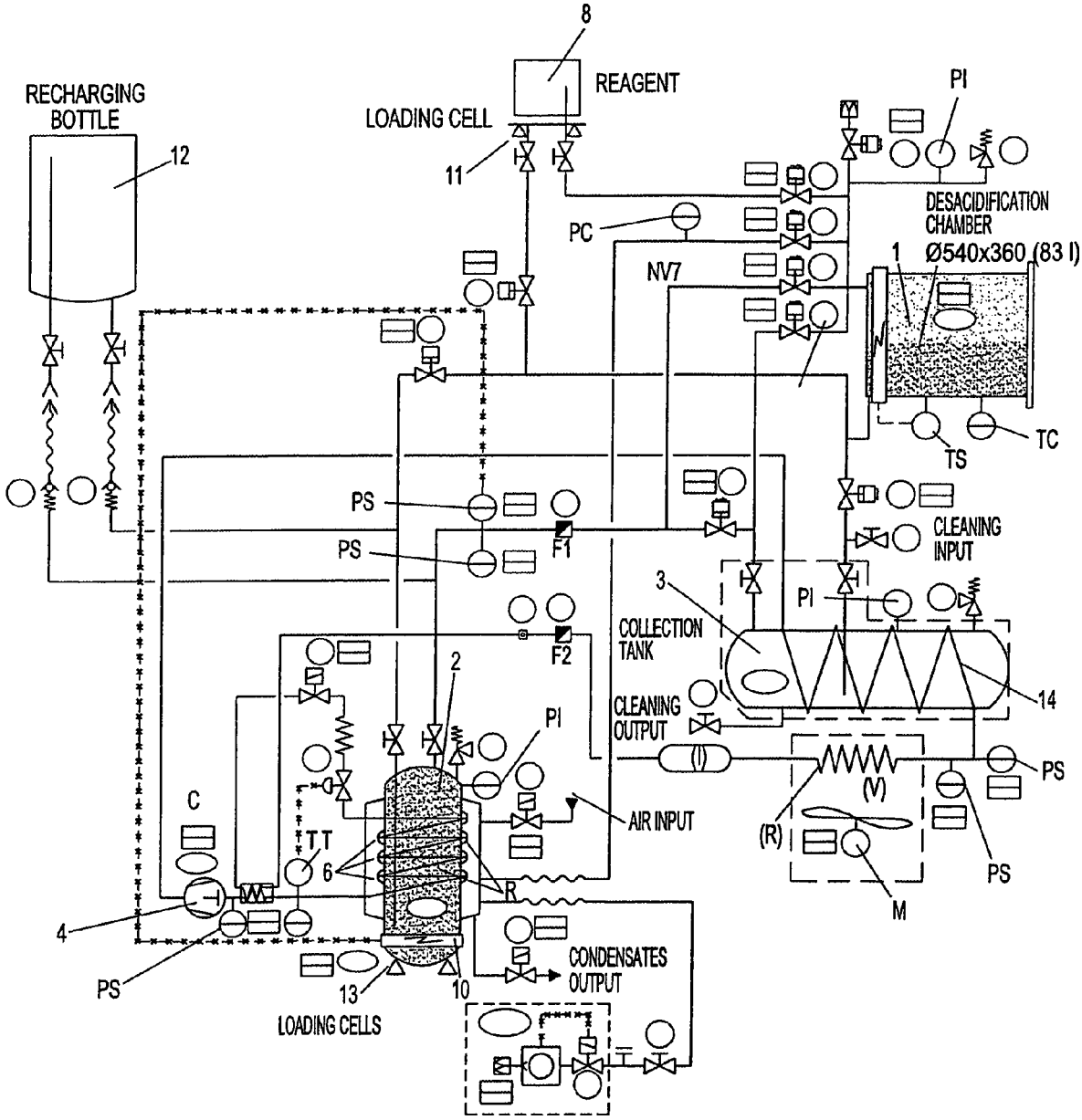
FIG. 7 shows a flow chart for the dilution of reagent with the solvent.

FIG. 7 presents the stage of the process at which the concentrated solution of the deacidifying reagent, deposited on the bottom of autoclave (1), is diluted by the solvent contained in tank (2) when it enters autoclave (1). In a specific embodiment, the diluent is HFC 227, and tank (2) is situated on a loading cell (13), so that by a program the reagent is diluted to concentrations between 3.9% and 4.5% depending on the acidity (pH measurement) of the material, for which 19.650 kg of solvent must be added. The procedure involves activation of the loading cell, heating of tank (2) by starting the heating system formed by heating bands (10) on the bottom of tank (2) and which are powered by a suitable power source, a simultaneous opening of pneumatic valve NV7, so that the HFC 227 can flow from tank (2) to autoclave (1); pneumatic valves NV3, NV8 remain closed. The reagent impregnation stage is effected as follows: from tank (8) with the evaluated reagent (concentration on the order of 70% by weight/weight of magnesium di-n-propylate carbonate), dissolved in n-propanol and HFC 227 the remaining 30%, by means of a loading cell it is automatically dosed according to the amount (in kg) of books placed in (1) which have been previously dehydrated.

Examples for the useful capacity of autoclave (1):

for 20 kg of books, 800 g of reagent, i.e. 1,143 g of product contained in the reagent vessel; then 19.7 kg of HFC 227 are added, reaching a 4% reagent concentration;

for 30 kg of books, 1,720 g of reagent and 29.55 kg of HFC 227 are added, for a total of 21+35+1.5 liters=57.5 liters capacity, leaving a residual air chamber of 83−58=25 liters;

for 40 kg of books, which is the best of amount to work with, 2,286 g of reagent product and 39.4 kg HFC 227 are added, with a density at 20° C. of 1.41 g/ml, making a total volume of 28 liters. As the average density of books is 0.86 g/ml, the total volume occupied by 40 kg of books and the suitable reagent solution is: 28+46.5+2=76.5 liters (the chamber has a volume of 83 liters, leaving 6.5 liters of volume as a safety chamber).

By weighing the quantities of reagent are introduced by a pneumatic valve NV2 which opens the circuit to the autoclave; after dosing of the amount by opening the manual valve of the HFC 227 tank and opening of pneumatic valve NV7, the number of kg programmed in the robot are entered. When the desired reagent concentration is reached which has been previously introduced in the robot according to the weight of the books and documents and their pH, pneumatic valve NV7 is automatically closed. Then the impregnation process begins, which lasts 3 hours as the carbonated reagent is less reactive than the corresponding uncarbonated magnesium n-propoxide. Diffusion is practically identical, thus ensuring homogeneity of the treatment, which is one of the differences with other current application methods. After the impregnation operation has finished autoclave (1) is emptied into tank (3) by gravity pouring, and the books collected from autoclave (1), and the device is ready for another batch. Shorter treatment times are not advisable for safety in the impregnation process as there is no prior selection of the paper on which the books are printed.

Figure 8:
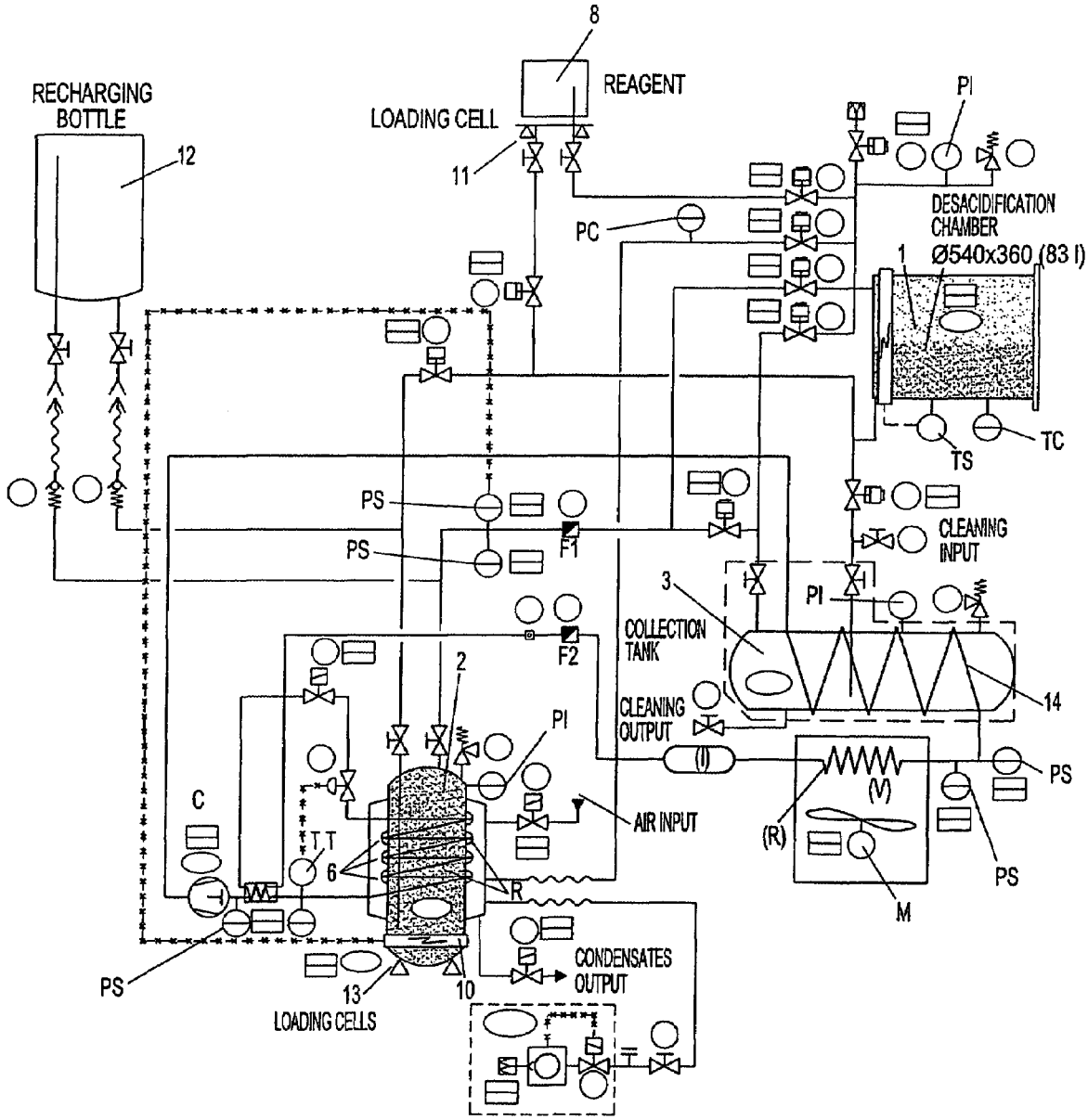
FIG. 8 shows a flow chart of the collection of the excess solution.

FIG. 8 shows the system used to empty the excess solution from the treatment, which is mainly HFC 227, excess reagent, an amount of glue dissolved by the HFC 227, dirt deposited on the books or documents and magnesium salts formed from the acid products extracted from the cellulosic materials. The process takes place by opening pneumatic valve NV5, and passes through permanently open manual valve MV6. A basic characteristic of this process is that it takes place quickly under the action of gravity and the simultaneous heating of autoclave (1) and cooling by the refrigeration system, passing the solution to tank (3) where it is stored until the start of the following stage of the process, which is recovery of the HFC 227.

Autoclave (1) can be then opened and the cellulosic material contained in it removed in order to introduce a new batch, to restart the dehydration process of FIG. 5. Thus, processing time is gained as this is a variation which is claimed, given that there is no waiting time in the process as the solution passes in a few minutes from autoclave (1) to tank (3) since distillation is independent of the dehydration process, these occurring simultaneously.

Figure 9:
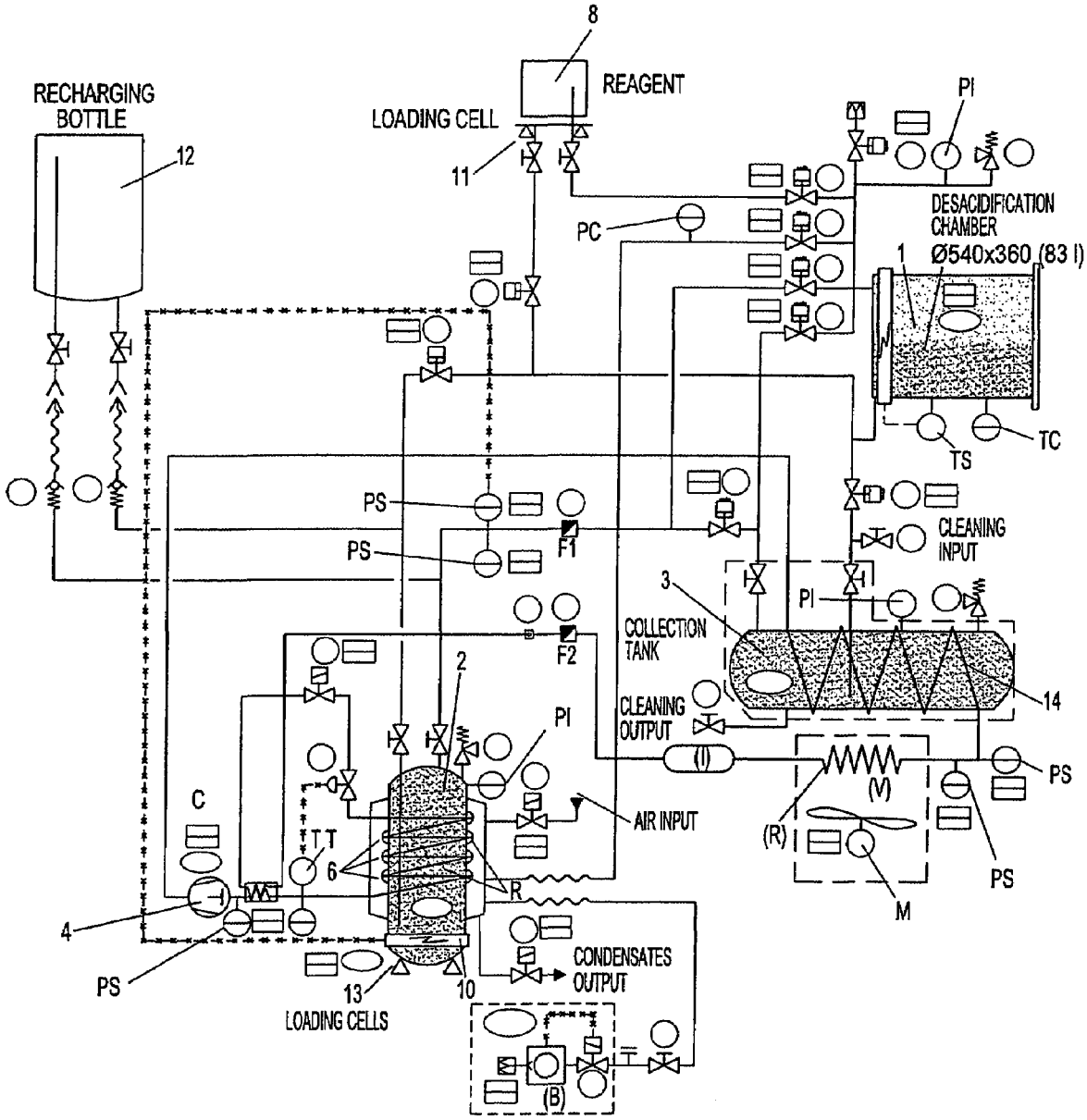
FIG. 9 shows the flow chart for distillation of the solvents of tank (3).

FIG. 9 shows the distillation stage for the solution stored in tank (3); it consists of heating said tank so that the solution arriving from the previous operation which has passed to this tank by heating of autoclave (1) to 45° C. and by gravity due to the design of the tank situation; this last condition is very important to obtain a quick process. After this operation is finished tank (3) is heated by a resistance passing the HFC 227 to the solvent tank placed over the loading cell, obtaining as complete a recovery as possible of the solvent by refrigeration of bottle (2). For this purpose manual valves VM8 and VM10 are opened, as well as pneumatic valve NV3, so that the HFC 227 of tank (3) passes to the solvent tank (2) which is refrigerated by compressor C, which is functioning and connected to the manual valve to allow refrigeration of said tank. Pneumatic valves NV6, NV5, NV7, NV4 and NV6 remain closed, as well as manual valve VM9, to conduct the HCF 227 to tank (2). The distillation process lasts around 6–7 hours and occurs simultaneously to dehydration of the books, which lasts depending on the weight of the books 4 hours, 5 hours and 20 minutes, and 6 hours and 40 minutes, respectively, for 20, 30 and 40 kg of books. When the distillation is considered to have finished the system is ready for the next stage of the process.

In tank (3) remain sludge and residues of the acidity soluble and dirt carried by the HCF 227 from the treated books. IN addition remains the n-propanol, which has a low vapour pressure compared to HFC 227, and is therefore not distilled although a small amount is carried along, which as well as the humidity is retained by filter F1. After a number of treatment operations for cellulosic materials, between 4 and 5, which may correspond to a week of using the machine, tank (3) is cleaned by opening manual valve MV5, letting in n-propanol, keeping open manual valve MV6, in its normal position, and air is allowed to enter causing a gurgling which stirs the residue with the added solvent. Then manual valve MV7 is opened as shown in FIG. 10, thereby removing residue left from the operational cycles.

Figure 10:
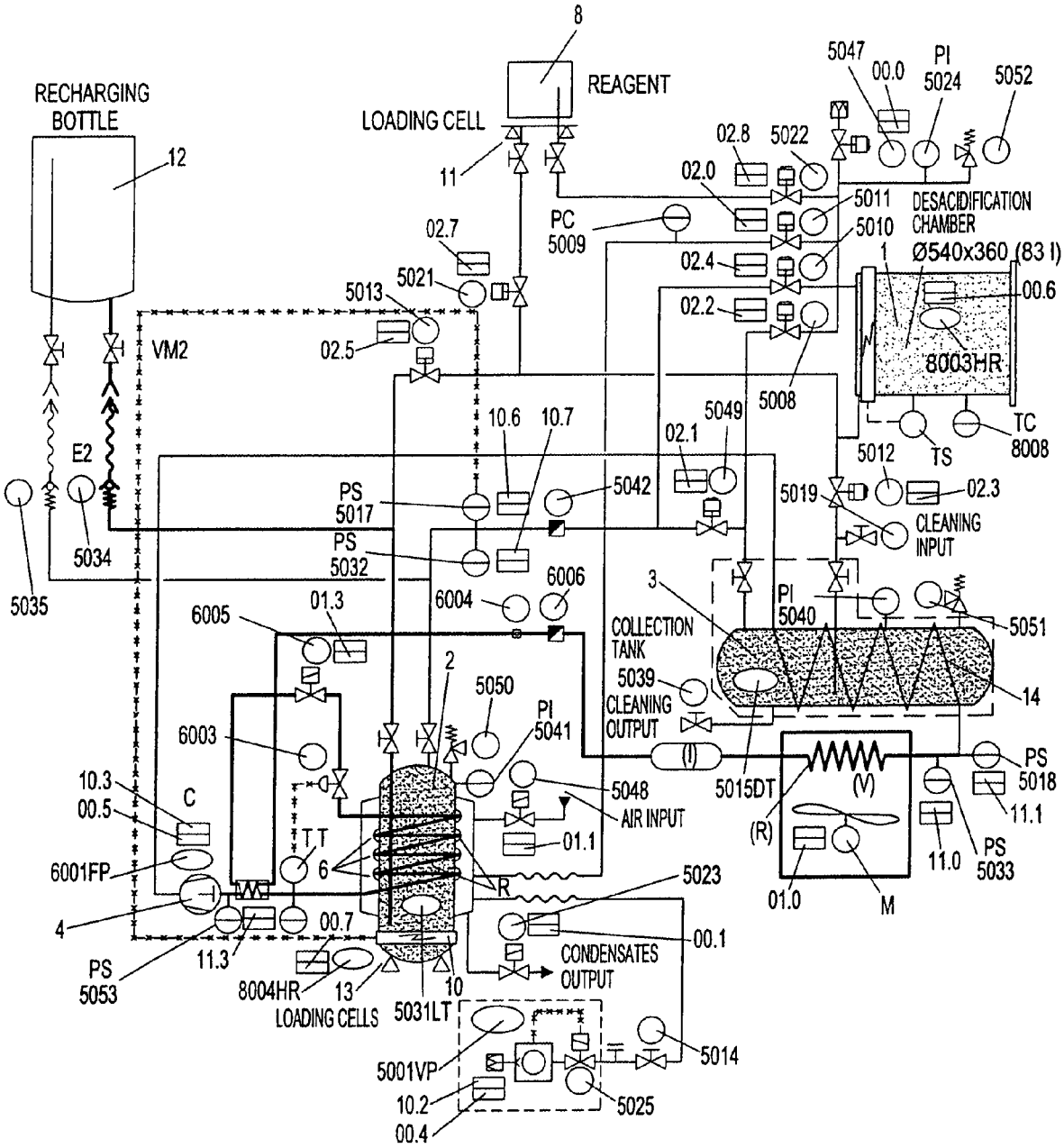
FIG. 10 shows the flow chart for reloading in the event of solvent loss in tank (2).

After a number of processes a weight loss is observed in the HFC 227 storage tank (2), as shown in FIG. 10, and if this is an appreciable amount it is recharged from the external tank connected to the system by bolted connections E1 and E2, with manual valve VM1 remaining closed and opening manual valves VM2 and VM8, for outlet of tank (12) and inlet of solvent bottle (2). Tank (2) is refrigerated as shown in the schematic by starting compressor-condenser C—R. The compressor and cold generating system together with a heat dissipation system is driven by a motor M which drives a fan (V). The insulating jacket condenses the water and has a condensate outlet electrovalve in a de-icing process, which takes place after cooling of the liquid in tank (2).

In the complementary procedure of the equipment described the following operations take place:

I) Dying/dehydration of the books in the autoclave: comprises heating to 50° C. and evacuation (see FIG. 5). This operation involves a number of cycles with entry of hot dry air in order to optimise the predrying time, which is on the order of 4 to 6 hours depending on the weight of the books, with a number of cycles between 30 and 50 each lasting about 8 minutes, so that the water content of the books passes from 6% or 8% to between 2% and 2.5%. This operation considers the fact that water is removed as a function of the vacuum and its heat conductivity. From these data the conclusion was reached that in order to shorten the predrying treatment times it is best to perform short evacuation and entry cycles of a valve allowing air entry so that dehydration is shortened from 48 hours to 4–6 hours. The electro valve is opened when pressures are reached on the order of 30–40 mbar, as at higher vacuums the thermal conductivity as a function of vapour weight is very low and the dehydration process becomes less efficient.

II) Deacidification treatment, comprising two stages:

a) dosification of the concentrated reagent formed by magnesium di-n-propylate carbonate in amounts ranging between 50% and 70% by weight, according to a prior evaluation, and between 50% and 30% in weight of HFC 227 and n-propanol (the later in minority amounts to avoid undesired effects); and b) solution of the previous reagent with HFC 227 from tank (2) so that concentrations are achieved between 3.5% and 4.5% by weight of pure reagent.

III) Impregnation and solvent recovery stage: the impregnation solution remains in contact with the books or documents for 3 hours to ensure an even penetration, reaction and distribution of the reagent. The remaining solution is then sent to tank (3) under gravity and cooling of tank (3). The recovered solution contains mainly HFC 227, with other products such as n-propanol, unreacted product, dirt from the books, a certain amount of glue dissolved by the HFC 227 and lastly, free acidity forming magnesium salts (magnesium sulphate and other salts).

IV) Distillation of the solvent: The solvent is distilled from tank (3) to bottle (2) by heating tank (3) and cooling bottle (2). Thus almost the entire amount of HFC 227 is recovered, and the viscous liquid of tank (3) retains the n-propanol which has a much lower vapour pressure than HFC 227, although a small amount may be carried, which does not harm the following cycle as this small amount evaporates; salts are left in the tank, as well as dirt and glues. This tank is cleaned after every 4 or 5 cycles to remove residues. The cleaning system is controlled by a number of manual valves and is adequately described in the operation of the machine.

IV) Opening of the autoclave and dehydration: A new batch may begin while the distillation process occurs, placing books in autoclave (1) once again.

V) Disinfestation: The machine may effect disinfestation of books and documents simultaneously to treatment in the dehydration and impregnation stages, as the heat and the vacuum cause elimination of oxygen in all cycles, but mainly because an anaerobic medium is created in the impregnation stage which makes insects and their larvae and eggs die due to lack of oxygen. In this machine the process may be performed independently by vacuum and then entry in the autoclave by a fast socket of nitrogen, carbon dioxide and HFC 227, leaving the books in overnight with any of these gases.

VI) Determination of the distribution of the alkaline reserve, pH and tensile resistance in the treated pages: Once the autoclave has been opened it is emptied of books and after a suitable conditioning the distribution of the treatment is determined by measuring the surface pH in several points of an inner page to check the even distribution of magnesium carbonate. The alkaline reserve and tensile strength of treated paper can also be determined.

EXAMPLES

A full deacidification treatment of a book with acidic pages has been performed with a 4% solution of active reagent [magnesium di-n-propylate carbonate diluted in HFC 227 and a small amount of n-propanol]. The experimental results of the treatment are given in table 1, which shows the data for the alkaline reserve, surface pH and tensile strength tests. The papers treated have different density and acidity. The first is photocopying paper for inkjet printers (Inapa Multioffice) with 80 g/m$^2$ density, DIN A4 with a 0.11 mm thickness and pH of 7.65; notebook paper with a density of 71.3 g/m$^2$ initially and an acidic pH of 5.33; paper from the book "Enciclopedia Catalana" with an initial density of 57.5 g/m$^2$ and an untreated paper pH of 6.29. The amount of paper treated was 25 kg in the 83 l capacity autoclave.

TABLE 1

Results of pages treated with 4% reagent

| Treatment in machine with 4% reagent | Alkaline reserve (mol/kg) | Break point (N) | Lengthening (mm) | Elastic limit (N) | Extension in the elastic limit (m) | Breaking length (m) | T.E.A. (J) | pH |
|---|---|---|---|---|---|---|---|---|
| Untreated photocopying paper Density 80.5 g/m$^2$. Aging 14 days. | 0.179 | | | | | | | 7.65 |
| | | DE 7.7 | DE 0.17 | DE 10.5 | DE 0.28 | DE 657 | DE 9.8 | |
| Longitudinal | | 65.8 | 1.88 | 35.0 | 6449 | 39.3 | | |
| | | DE 7.7 | DE 0.17 | DE 10.5 | DE 0.28 | DE 657 | DE 9.8 | |
| Transversal | 32.8 | 3.66 | 18.8 | 1.32 | 2791 | 51.0 | | |
| | | DE 1.3 | DE 0.59 | DE 3.0 | DE 0.30 | DE 107 | DE 11.8 | |
| Untreated photocopying paper. Density 80.5 g/m$^2$. Aging 28 days | 0.166 | | | | | | | 7.09 |
| Longitudinal | | 61.9 | 1.66 | 26.5 | 0.90 | 5314 | 27.7 | |
| | | DE 3.4 | DE 0.16 | DE 9.2 | DE 0.15 | DE 293 | DE 5.3 | |
| Transversal | 33.0 | 3.39 | 18.8 | 1.29 | 2851 | 45.7 | | |
| | | DE 1.6 | DE 0.28 | DE 2.7 | DE 0.20 | DE 140 | DE 6.7 | |
| Treated photocopying paper. Density 82 g/m$^2$. Unaged | 0.921 | | | | | | | 10.16 |
| Longitudinal | | 80.7 | 2.86 | 36.3 | 0.94 | 6572 | 55.1 | |
| | | DE 3.6 | DE 0.16 | DE 3.2 | DE 0.17 | DE 297 | DE 6.4 | |
| Transversal | | 39.5 | 6.72 | 15.8 | 1.15 | 3275 | 83.0 | |
| | | DE 1.4 | DE 0.33 | DE 1.0 | DE 0.09 | DE 116 | DE 6.2 | |
| Treated paper. Density 79.2 g/m$^2$. Unaged. | 0.182 | | | | | | | 7.96 |
| Longitudinal | 64.7 | 2.69 | 23.7 | 0.96 | 5574 | 41.4 | | |
| | | DE 3.3 | DE 0.14 | DE 3.0 | DE 0.08 | DE 285 | DE 3.6 | |
| Transversal | | 31.8 | 6.95 | 13.6 | 1.23 | 2691 | 68.8 | |
| | | DE 1.9 | DE 0.48 | DE 1.2 | DE 0.10 | DE 161 | DE 7.7 | |
| Treated Aging 14 days | 0.878 | | | | | | | 10.01 |
| Longitudinal | | 66.7 | 1.83 | 25.8 | 0.93 | 5520 | 34.3 | |
| | | DE 5.9 | DE 0.20 | DE 7.9 | DE 0.11 | DE 490 | DE 9.4 | |
| Transversal | 34.9 | 3.95 | 16.6 | 1.11 | 2890 | 60.0 | | |
| | | DE 1.6 | DE 0.32 | DE 0.8 | DE 0.09 | DE 1130 | DE 7.5 | |
| Treated Density 81.6 g/m$^2$ Aging 28 days | 0.865 | | | | | | | 9.92 |
| Longitudinal | 67.4 | 2.01 | 14.3 | 0.79 | 5515 | 40.6 | | |
| | | DE 4.4 | DE 0.21 | DE 4.6 | DE 0.07 | DE 363 | DE 9.5 | |
| Transversal | 35.2 | 4.11 | 17.4 | 1.19 | 2931 | 63.4 | | |
| | | DE 1.9 | DE 0.32 | DE 4.6 | DE 0.24 | DE 160 | DE 9.1 | |

TABLE 1-continued

| Treatment in machine with 4% reagent | Alkaline reserve (mol/kg) | Break point (N) | Lengthening (mm) | Elastic limit (N) | Extension in the elastic limit (m) | Breaking length (m) | T.E.A. (J) | pH |
|---|---|---|---|---|---|---|---|---|
| | | Results of pages treated with 4% reagent | | | | | | |
| Notebook paper Density 71.3 g/m$^2$ Untreated | −0.103 | | | | | | | 5.59 |
| Longitudinal | | 42.8 | 2.08 | 22.9 | 1.08 | 4085 | 18.8 | |
| | | DE 2.4 | DE 0.13 | DE 3.0 | DE 0.11 | DE 231 | DE 2.8 | |
| Transversal | 24.6 | 3.66 | 14.8 | 1.29 | 2347 | 26.4 | | |
| | | DE 0.7 | DE 0.22 | DE 0.9 | DE 0.11 | DE 69 | DE 2.7 | |
| Notebook paper Density 77.5 g/m$^2$ Untreated Aging 14 days | −0.096 | | | | | | | 4.61 |
| Longitudinal | | 34.6 | 1.21 | 21.4 | 0.94 | 3040 | 8.7 | |
| | | DE 7.1 | DE 0.16 | DE 5.5 | DE 0.10 | DE 627 | DE 3.6 | |
| Transversal | | 23.1 | 1.98 | 14.3 | 1.07 | 2031 | 15.8 | |
| | | DE 1.5 | DE 0.18 | DE 5.0 | DE 0.22 | DE 132 | DE 2.6 | |
| Notebook paper Density 70 g/m$^2$ Untreated Aging 28 days | −0.124 | | | | | | | 4.38 |
| Longitudinal | | 25.4 | 1.08 | 18.6 | 0.91 | 2476 | 4.9 | |
| | | DE 3.0 | DE 0.10 | DE 3.4 | DE 0.11 | DE 288 | DE 1.3 | |
| Transversal | | 16.6 | 1.54 | 12.8 | 1.14 | 1633 | 7.7 | |
| | | DE 3.8 | DE 0.30 | DE 4.6 | DE 0.25 | DE 373 | DE 3.5 | |
| Notebook paper Density 75.2 g/m$^2$ Treated. Unaged | 1.201 | | | | | | | 9.93 |
| Longitudinal | | 49.0 | 1.84 | 22.3 | 0.95 | 4310 | 18.1 | |
| | | DE 4.2 | DE 0.14 | DE 6.4 | DE 0.18 | DE 366 | DE 3.8 | |
| Transversal | | 21.1 | 3.40 | 12.6 | 1.08 | 1852 | 21.1 | |
| | | DE 1.1 | DE 0.35 | DE 0.7 | DE 0.06 | DE 98 | DE 3.6 | |
| Notebook paper Density 69.2 g/m$^2$ Treated Aging 14 days | 1.120 | | | | | | | 9.29 |
| Longitudinal | 36.7 | 1.45 | 17.3 | 0.83 | 3605 | 14.0 | | |
| | | DE 2.5 | DE 0.12 | DE 6.1 | DE 0.14 | DE 244 | DE 2.3 | |
| Transversal | 20.5 | 2.43 | 13.0 | 1.15 | 2017 | 19.9 | | |
| | | DE 1.0 | DE 0.16 | DE 4.1 | DE 0.23 | DE 99 | DE 2.6 | |
| Notebook paper Density 70.5 g/m$^2$ Treated Aging 28 days | 1.050 | | | | | | | 8.85 |
| Longitudinal | | 31.0 | 1.21 | 20.7 | 0.98 | 2769 | 7.9 | |
| | | DE 9.3 | DE 0.17 | DE 4.8 | DE 0.08 | DE 829 | DE 4.1 | |
| Transversal | 18.0 | 1.84 | 14.6 | 1.25 | 1741 | 10.9 | | |
| | | DE 1.7 | DE 0.27 | DE 1.2 | DE 0.13 | DE 163 | DE 4.3 | |
| Enc. Catalana Density 57 g/m$^2$ Untreated | 0.021 | | | | | | | 6.29 |
| Longitudinal | | 27.4 | 1.72 | 13.3 | 0.97 | 3273 | 13.1 | |
| | | DE 1.6 | DE 0.12 | DE 7.6 | DE 0.33 | DE 187 | DE 1.6 | |
| Enc. Catalana Density 64.2 g/m$^2$ Treated | 0.983 | | | | | | | 9.86 |
| Longitudinal | 36.7 | 1.07 | 23.1 | 0.82 | 3841 | 13.7 | | |
| | | DE 4.5 | DE 0.12 | DE 3.5 | DE 0.06 | DE 402 | DE 2.2 | |
| Enc. Catalana Density 56.5 g/m$^2$ Untreated Aging 14 days | −0.152 | | | | | | | 5.10 |
| Longitudinal | | 29.6 | 1.49 | 19.9 | 1.13 | 3570 | 10.8 | |
| | | DE 5.9 | DE 0.20 | DE 6.3 | DE 0.20 | DE 705 | DE 4.3 | |
| Enc. Catalana Density 58.11 g/m$^2$ Untreated Aging 28 days | −0.137 | | | | | | | 5.14 |
| Longitudinal | | 32.1 | 1.48 | 23.4 | 1.15 | 3756 | 11.4 | |
| | | DE 4.9 | DE 0.15 | DE 2.2 | DE 0.05 | DE 575 | DE 3.2 | |

TABLE 1-continued

| Treatment in machine with 4% reagent | Alkaline reserve (mol/kg) | Break point (N) | Lengthening (mm) | Elastic limit (N) | Extension in the elastic limit (m) | Breaking length (m) | T.E.A. (J) | pH |
|---|---|---|---|---|---|---|---|---|
| | | Results of pages treated with 4% reagent | | | | | | |
| Enc. Catalana Density 64.5 g/m$^2$ Treated Aging 14 days | 0.894 | | | | | | | 9.53 |
| Longitudinal | | 35.5 DE 2.9 | 1.45 DE 0.13 | 22.9 DE 2.8 | 0.98 DE 0.08 | 3606 DE 398 | 12.2 DE 2.3 | |
| Enc. Catalana Density 64.7 g/m$^2$ Treated Aging 28 days | 0.839 | | | | | | | 9.37 |
| Longitudinal | | 34.5 DE 3.8 | 1.55 DE 0.09 | 24.4 DE 3.5 | 1.02 DE 0.11 | 3574 DE 369 | 13.3 DE 1.4 | |

Alkaline reserve has been determined according to Standards UNE 57.174 and ISO 287:1985.
Tenile strength-elongation tests have been determined according to Standards UNE 57028 and ISO 1924/2.
pH was determined by measurement with plane electrode according to Standard TAPPI T529 om-88. pH is calculated by averaging six values in different areas of the page.
DE indicates the standard deviation of measurements which were performed seven times for each sample.

I claim:

1. A device for mass deacidification, elimination of free acidity and disinfestation of cellulosic materials comprising an autoclave with pressure and temperature control, and capable of receiving the cellulosic materials to be treated; a solvent bottle fluidly connected to the autoclave; a first loading cell receiving the solvent bottle and programmed to determine the amount of solvent for each process; a dosification tank in fluid communication with the autoclave containing a concentrated reagent and capable of introducing the correct amount of reagent depending on the weight of the material to be treated; and a tank for gravity collection of the residual solution arriving from the autoclave for its subsequent recovery wherein the residual solution collection tank has a heating system for heating to distill the solvent contained in the residual solution.

2. The device of claim 1 wherein the residual solution collection tank has a refrigeration system used during emptying of autoclave.

3. The device of claim 1, wherein the connection between autoclave and the residual solution collection tank can be opened and closed by a manual or an automatic valve.

4. The device of claim 1, wherein the solvent bottle has an external refrigeration system or a heating system.

5. The device of claim 4, wherein the solvent bottle has a refrigeration system comprising a hermetic compressor, a condenser and a refrigerating jacket which envelopes the top part of solvent bottle.

6. The device of claim 5, wherein the device has a de-icing system to eliminate frost on the jacket covering the solvent bottle which forms during the distillation process, comprising a fan driven by a motor and a heating resistance.

7. The device of claim 6, wherein the device has a valve in said jacket for automatic outlet of condensates.

8. The device of claim 4, wherein the device has a heat exchanger connected to the solvent bottle and the residual solution collection tank which optimizes the refrigeration of the solvent bottle and uses the heat generated to heat the residual solution collection tank.

9. The device of claim 1, wherein the residual solution collection tank has an inlet for a cleaning fluid, selected from the group consisting of anhydrous n-propanol, and air.

10. The device of claim 9, wherein the residual solution collection tank has an evacuation valve for the suspension formed after the distillation process.

11. The device of claim 1, wherein a vacuum pump is connected to the autoclave.

12. The device of claim 1, wherein the device has a second loading cell on which is placed the dosification tank of concentrated reagent.

13. The device of claim 1, wherein the device has a programmable robot for controlling the processes of the unit automatically.

14. The device of claim 13, wherein the device has a touch screen from which the type and stages of the process may be selected according to the amount of material to be treated.

15. The device of claim 14, wherein the device has a series of pneumatic valves (NV1, NV2, NV3, NV4, NV5, NV6, NV7, NV8) controlled by the robot and activated by the touch screen connected to the robot.

16. The device of claim 15, wherein the device has a set of electrovalves (EV1, EV2) which open or close passages in several stages of the process.

17. The device of claim 1, wherein the device has a series of manual valves (VM1, VM2, VM3, VM4, VM5, VM6, VM7, VM8, VM9, VM10) related to maintenance, replacing liquids or inlet of reagents and solvent.

18. The device of claim 1, wherein the device has a recharging bottle connected to the system for recharging the solvent bottle according to the losses caused during the process.

19. The device of claim 1, wherein the autoclave has a lid with a hermetic seal, a pressure gauge, a safety valve, a temperature control thermocouple inside the autoclave, a pressure and vacuum measurement system, an external temperature control gauge and heating bands on the outside wall of autoclave.

20. The device of claim 1, wherein the device has as safety measures a safety valve in the upper section of the solvent bottle and a safety valve in the upper part of residual solution collection tank.

21. The device of claim 1, wherein the device has a filter indicating humidity absorption in a connection duct between the solvent bottle to the autoclave.

22. The device of claim 1, wherein the dosification tank of concentrated reagent is connected to the autoclave so that the correct amount of concentrated reagent passes directly to the autoclave where the final desired concentration will be later obtained by direct conduction of solvent from the solvent bottle to the inner chamber of the autoclave.

23. The device of claim 22, wherein the autoclave has an inlet for solvent and concentrated reagent which is alternately connected to the dosification tank of concentrated reagent or to the pure solvent bottle.

24. A method of treating a cellulose-containing material comprising, in an autoclave:

exposing a cellulose-containing material to at least one cycle of oscillating pressure comprising exposing the cellulose-containing material to atmospheric pressure and exposing the cellulose-containing material to a vacuum;

conveying a deacidifying amount of a deacidifying agent and a carrier into the autoclave under a vacuum; and impregnating said cellulose-containing material with said deacidifying agent and carrier mixture and wherein the carrier comprises HCF 227, n-propanol, or both and further comprising draining the residual mixture from the autoclave to a residual solution tank;

distilling the collected remaining mixture within the residual solution tank to produce a vapor; and conveying the vapor to a solvent bottle.

25. The method of claim 24, wherein the number of oscillating pressure cycles is from about 10 to about 50.

26. The method of claim 24, wherein the number of oscillating pressure cycles is sufficient to reduce the water content of the cellulose-containing material to less than about 2.5% by weight.

27. The method of claim 26, wherein the cellulose-containing material has a water content from about 2% to about 2.5% by weight.

28. The method of claim 24, wherein vacuum has a pressure from about 30 millibars to about 40 millibars.

29. The method of claim 24, wherein a temperature in the autoclave is less than about 50° C.

30. The method of claim 24, wherein a constant temperature is maintained in the autoclave.

31. The method of claim 24, wherein the deacidifying agent is conveyed into the autoclave by the autoclave vacuum.

32. The method of claim 24, wherein the carrier is conveyed into the autoclave before the deacidifying agent is conveyed into the autoclave.

33. The method of claim 24, wherein the deacidifying agent is a carbonate of magnesium di-n-propylate.

34. The method of claim 24, wherein the amounts of deacidifying agent and carrier conveyed into the autoclave are metered to achieve a predetermined concentration of deacidifying agent.

35. The method of claim 24, wherein the capacity of the autoclave is about 80 liters, the number of oscillating pressure cycles is between about 10 and about 50, the duration of each oscillating pressure cycle is about 8 minutes, and the mass of the cellulose-containing material is from about 20 kg to about 60 kg.

36. The method of claim 24 further comprising conveying a metered amount of deacidifying agent to a premixing chamber;

conveying a metered amount of carrier to a premixing chamber; and mixing said deacidifying agent and carrier wherein the contents of the premixing chamber are not conveyed into the autoclave until mixing is substantially complete.

37. The method of claim 36, wherein the deacidifying agent conveyed to the premixing chamber is in solution at a concentration of from about 50% to about 70% by weight.

38. The method of claim 36, wherein the carrier conveyed to the premixing chamber is preheated.

39. The method of claim 36, wherein the deacidifying agent in the mixture prior to conveyance into the autoclave has a concentration from about 2.0% to about 4.5% by weight.

40. The method of claim 36, wherein the method is automated.

41. The method of claim 24, wherein a duration of impregnation is about three hours.

42. The method of claim 24, wherein the residual mixture is conveyed to the residual solution tank by gravity, heat, or both gravity and heat.

43. The method of claim 24 further comprising condensing the vapor to form a distillate.

44. The method of claim 43, wherein condensation of the vapor occurs in the solvent bottle.

45. The method of claim 44, wherein the solvent bottle has a temperature of less than about 25° C.

46. The method of claim 24 further comprising removing the cellulose-containing material from the autoclave during distillation.

47. The method of claim 46 further comprising exposing in said autoclave a second cellulose-containing material to at least one cycle of oscillating pressure comprising exposing the cellulose-containing material to atmospheric pressure and exposing the cellulose-containing material to a vacuum; during the distillation.

48. The method of claim 47, wherein the method is automated.

49. The method of claim 24 further comprising exposing the cellulose-containing material to an atmosphere substantially free of oxygen.

50. The method of claim 49, wherein the atmosphere substantially free of oxygen comprises nitrogen, carbon dioxide, HCF 227 or combinations thereof.

51. The method of claim 49, wherein the atmosphere substantially free of oxygen in the autoclave has a pressure from about 30 millibars to about 2 bars.

52. The method of claim 49, wherein a duration of exposure to the atmosphere substantially free of oxygen is sufficient to kill substantially all insects and/or insect larvae.

53. The method of claim 49, wherein a duration of exposure to the atmosphere substantially free of oxygen is from about 4 hours to about 6 hours.

54. The method of claim 24, wherein the method is automated.

55. The method of claim 24, wherein the method is automated.

56. The method of claim 24 further comprising a results control stage at the end of the process.

57. The method of claim 56, wherein the results control stage comprises determining the magnesium distribution in the treated material before and after treatment by means of a scanning electron microscope (SEM), and by identification and quantitative determination by scanning with an electronic microprobe and determination of the pH with a plane electrode in several parts of the pages selected by random sampling.

58. The method of claim 57 further comprising making transverse cuts in the cellulose-containing material in order to observe the distribution of magnesium particles along the incision.

59. A method of treating cellulose-containing materials comprising:

in an autoclave, exposing a first cellulose-containing material to at least one cycle of oscillating pressure comprising exposing the first cellulose-containing material to atmospheric pressure and exposing the first cellulose-containing material to a vacuum;

conveying a metered amount of deacidifying agent to a premixing chamber;

conveying a metered amount of carrier to a premixing chamber;

mixing said deacidifying agent and carrier in the premixing chamber;

conveying a deacidifying amount of a deacidifying agent and a carrier into the autoclave under a vacuum;

impregnating said first cellulose-containing material with said mixture;

conveying remaining mixture to a residual solution tank;

distilling the collected remaining mixture to produce a vapor;

conveying the vapor to a solvent bottle;

condensing the vapor within the solvent bottle to produce a distillate;

removing the first cellulose-containing material from the autoclave during said distillation; and exposing a second cellulose-containing material, during distillation, to at least one cycle of oscillating pressure comprising exposing the second cellulose-containing material to atmospheric pressure and exposing the second cellulose-containing material to a vacuum.

60. A method of treating cellulose-containing materials comprising:

in an autoclave, exposing a first cellulose-containing material to at least one cycle of oscillating pressure comprising exposing the first cellulose-containing material to atmospheric pressure and exposing the first cellulose-containing material to a vacuum;

conveying a metered amount of deacidifying agent and a metered amount of carrier into the autoclave wherein the deacidifying agent is conveyed into the autoclave at the same time as or after the carrier is conveyed into the autoclave;

impregnating said first cellulose-containing material with said mixture;

conveying remaining mixture to a residual solution tank;

distilling the collected remaining mixture to produce a vapor;

conveying the vapor to a solvent bottle;

condensing the vapor within the solvent bottle to produce a distillate;

removing the first cellulose-containing material from the autoclave during said distillation; and exposing a second cellulose-containing material, during distillation, to at least one cycle of oscillating pressure comprising exposing the second cellulose-containing material to atmospheric pressure and exposing the second cellulose-containing material to a vacuum.

* * * * *